US012734426B2

(12) United States Patent
Rose

(10) Patent No.: US 12,734,426 B2
(45) Date of Patent: Sep. 15, 2026

(54) ARM, LEG AND CORE EXERCISE MACHINES

(71) Applicant: Greg Rose, Littleton, CO (US)

(72) Inventor: Greg Rose, Littleton, CO (US)

( * ) Notice: Subject to any disclaimer, the term of this patent is extended or adjusted under 35 U.S.C. 154(b) by 356 days.

(21) Appl. No.: 17/882,352

(22) Filed: Aug. 5, 2022

(65) Prior Publication Data

US 2024/0042304 A1 Feb. 8, 2024

(51) Int. Cl.

*A63B 23/14* (2006.01)
*A63B 21/00* (2006.01)
*A63B 71/06* (2006.01)

(52) U.S. Cl.

CPC ..... *A63B 71/0622* (2013.01); *A63B 21/154* (2013.01); *A63B 21/4035* (2015.10); *A63B 23/14* (2013.01); *A63B 2071/0638* (2013.01)

(58) Field of Classification Search

CPC ..... A63B 71/0622; A63B 21/154; A63B 21/4035; A63B 23/14; A63B 2071/0638; A63B 21/4033; A63B 21/4034; A63B 69/0062; A63B 21/063; A63B 21/4047; A63B 21/4049; A63B 23/0205; A63B 23/0216; A63B 23/03525; A63B 23/03541; A63B 23/0488; A63B 23/1281; A63B 23/16; A63B 21/0628

See application file for complete search history.

(56) References Cited

U.S. PATENT DOCUMENTS

| | | | | |
|---|---|---|---|---|
| 4,907,795 | A | 3/1990 | Shaw et al. | |
| 7,922,629 | B1 * | 4/2011 | Batca | A63B 23/1263 482/92 |
| 9,776,034 | B2 * | 10/2017 | Higgins | A63B 21/0628 |
| 2009/0075791 | A1 | 3/2009 | Kissel et al. | |
| 2011/0251021 | A1 | 10/2011 | Zavadsky et al. | |
| 2014/0057761 | A1 * | 2/2014 | Higgins | A63B 23/1209 482/94 |
| 2023/0310932 | A1 | 10/2023 | Rose | |
| 2023/0372768 | A1 * | 11/2023 | Park | A63B 21/4011 |
| 2023/0381570 | A1 * | 11/2023 | Rose | A63B 23/1245 |

FOREIGN PATENT DOCUMENTS

| | | | |
|---|---|---|---|
| CN | 109350925 | A | 2/2019 |
| DE | 102020126469 | A1 | 4/2022 |

* cited by examiner

*Primary Examiner* — Megan Anderson
*Assistant Examiner* — Catrina A Letterman
(74) *Attorney, Agent, or Firm* — Gregory Perrone

(57) ABSTRACT

An upper extremity, lower extremity, and core weight resistance mechanical exercise apparatus having a sequence of novel pulley systems and continuous cabling allowing customized isolated and compound exercises with plate lifting assistance and quicker and easier selection of resistances without moving from the user seat, and user-selectable resistances from graded, weight plate stacks with each plate increasing as the selected weight is increased.

5 Claims, 47 Drawing Sheets

ARM, LEG AND CORE EXERCISE MACHINES

INCORPORATION BY REFERENCE

Co-pending U.S. patent application Ser. No. 17/825,991 filed May 26, 2022, naming the same inventor as the present application, is incorporated herein by reference in its entirety.

FIELD OF THE DISCLOSURE

The claimed subject matter relates to a novel apparatus for providing graded weight resistance training for the upper extremities, lower extremities, and core comprising a novel pulley system and continuous cabling.

BACKGROUND

The elbow and knee joints are largely lever joints with a markedly simpler movement that the ball joints of the shoulder or hip. The wrist and ankle joints are not strictly ball and socket joints but operate similarly.

As discussed in a previous patent application, maximum muscle building efficiency is achieved when the user fully exercises a particular muscle or muscle group to failure. This is facilitated by the novel, highly efficient method of changing the weight selection with foot pedals for Gunner and a hand controlled level system for Centaur without a significant pause or need to move from the apparatus. As before, Gunner and Centaur include a video screen with multiple functions listed in the previous patent submission.

Currently most resistance exercise equipment for the arms, legs, and core exercise only one muscle group lacking a quick way to change the weight or position of the exercise, ability to perform isolated or compound exercises, an integrated, multipurpose video screen, nor the ability to do all exercises from the same location.

BRIEF DESCRIPTIONS OF THE DRAWINGS

The novel features believed characteristic of the inventions are set forth in the appended claims. The inventions themselves, however, as well as a preferred mode of use, further objectives, and advantages thereof, will be best understood by reference to the following detailed description of illustrative embodiments when read in conjunction with the accompanying drawings, wherein:

Figure 10A:
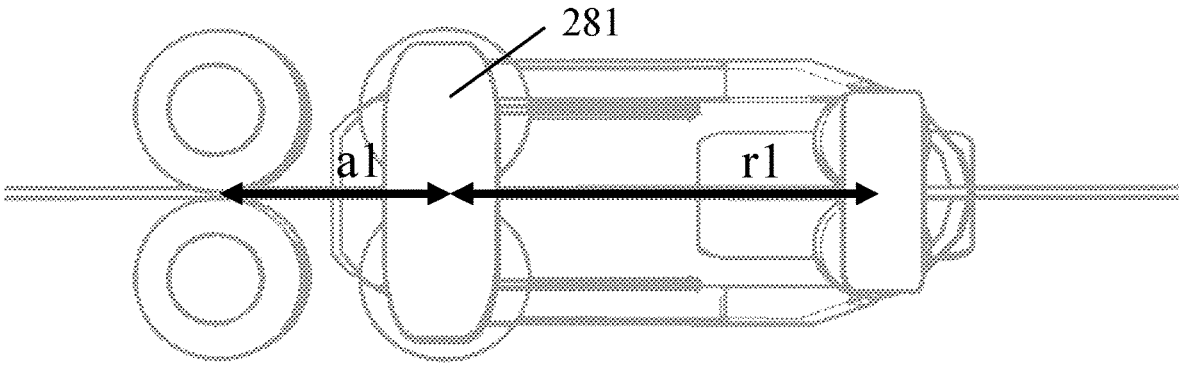
Figure 10B:
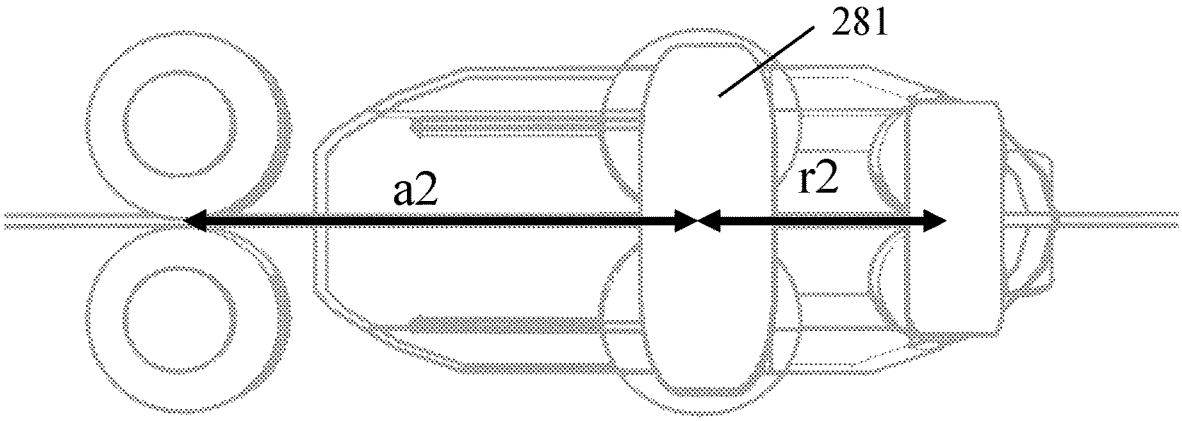

FIGS. 10A and 10*b* are top views of various points of operation of a cable pull unit of an upper extremity exercise apparatus according to an embodiment.

Figure 11:
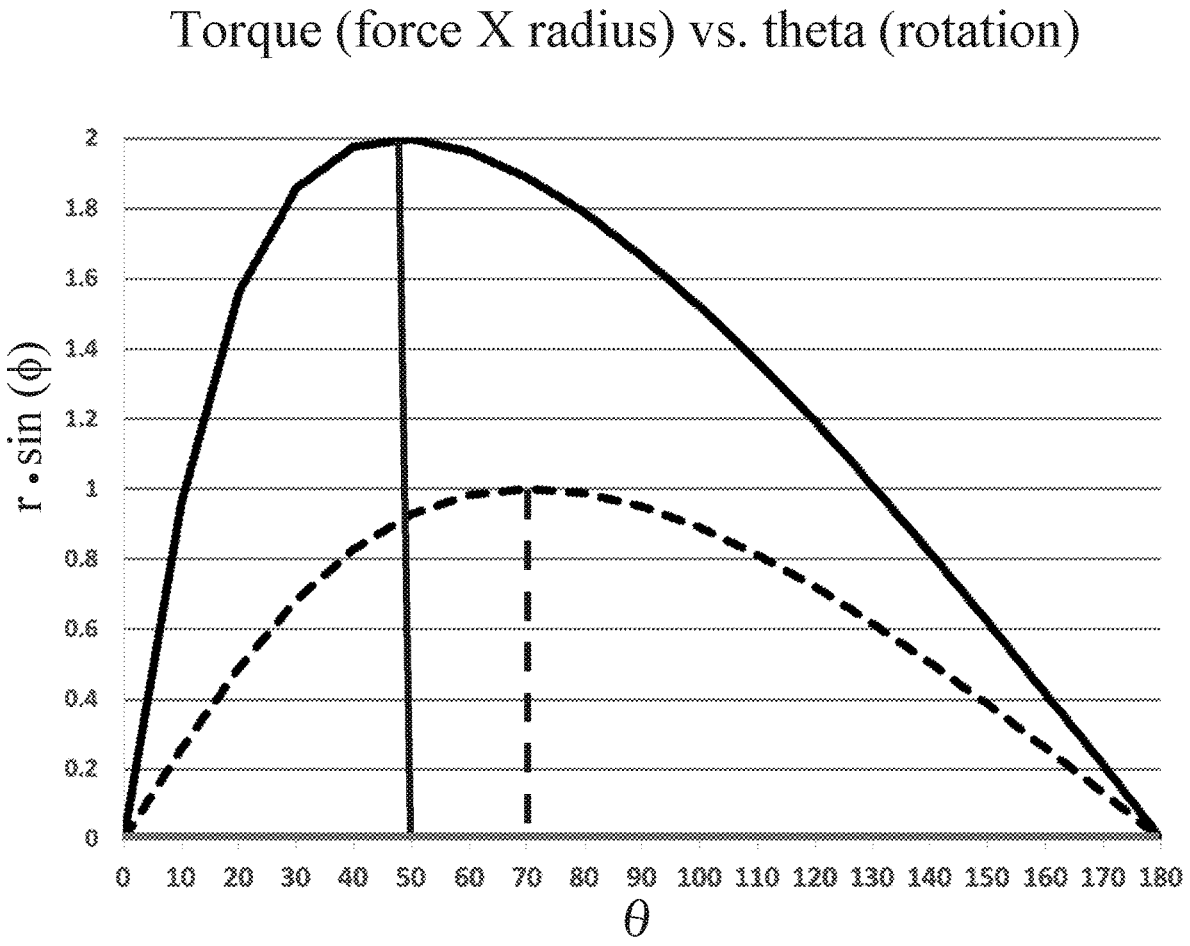

FIG. 11 is a graph representing torque versus rotation during operation of a cable pull unit of an upper extremity exercise apparatus according to an embodiment.

Figure 12A:
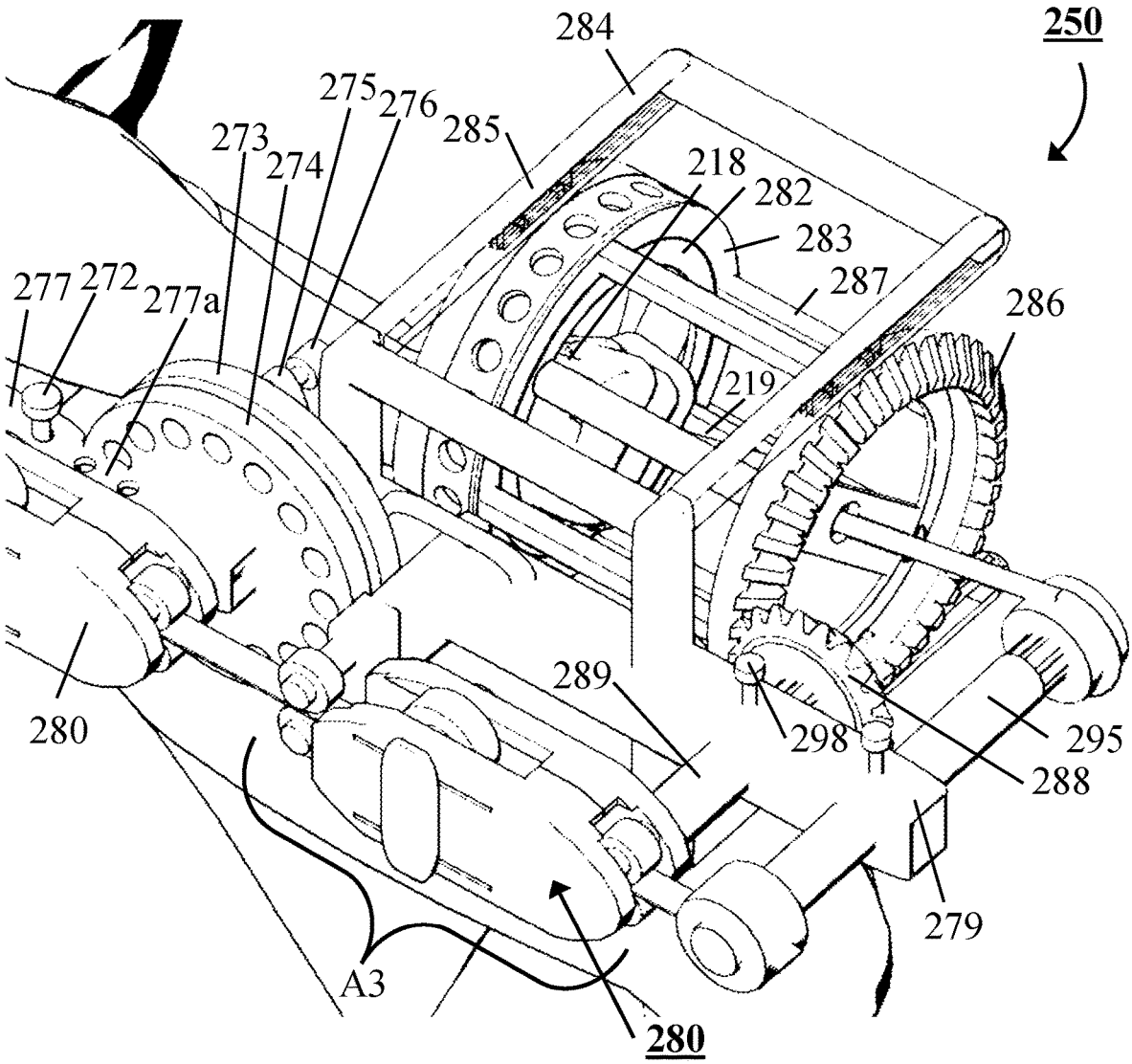

FIG. 12A is a perspective view of a wrist exerciser of an upper extremity exercise apparatus according to an embodiment.

Figure 12B:
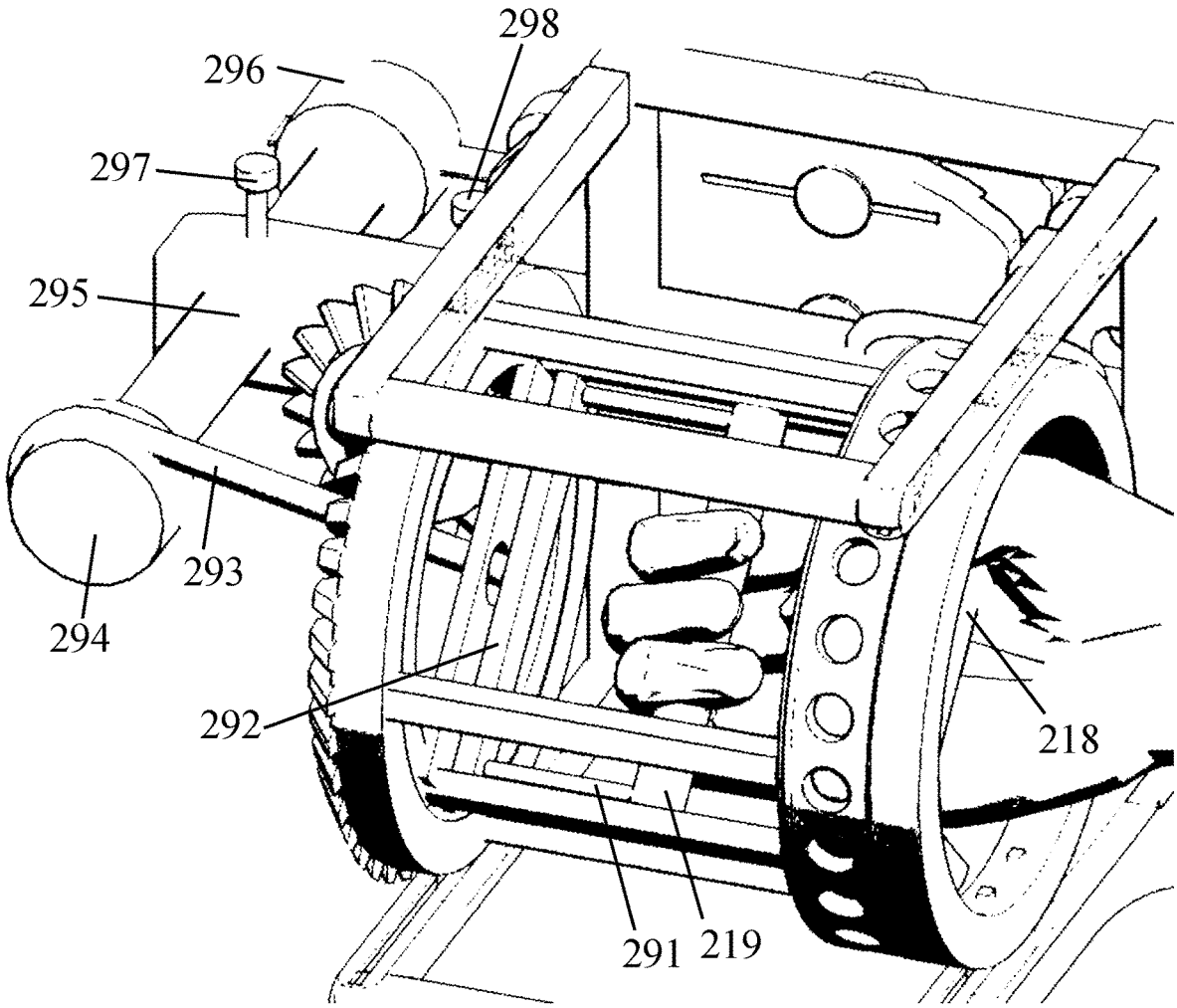

FIG. 12B is a perspective view of a wrist exerciser of an upper extremity exercise apparatus according to an embodiment.

Figure 13:
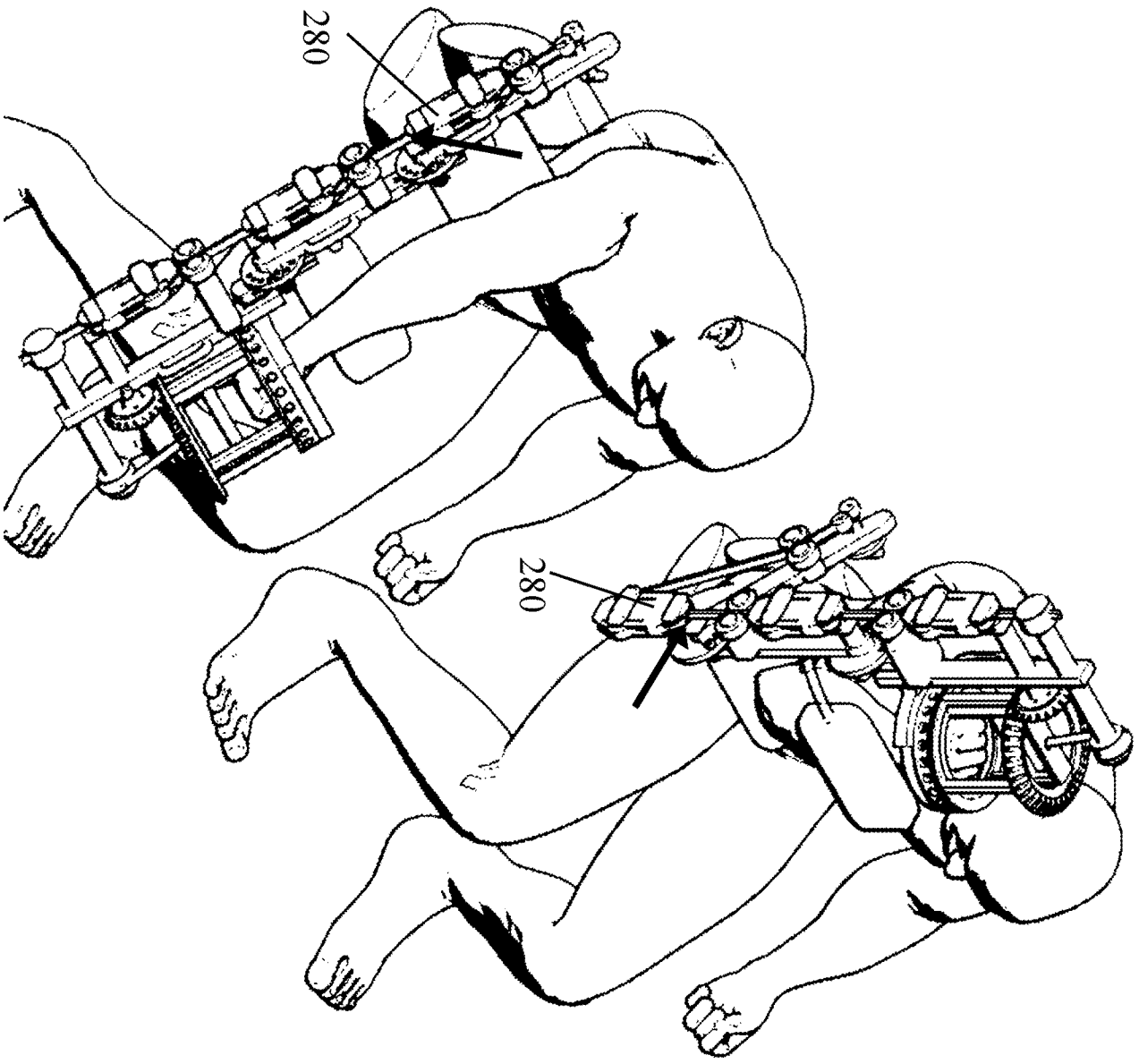

FIG. 13 depicts a user operation of an upper extremity exercise apparatus for biceps exercise in a preacher curl type position according to an embodiment.

Figure 14:
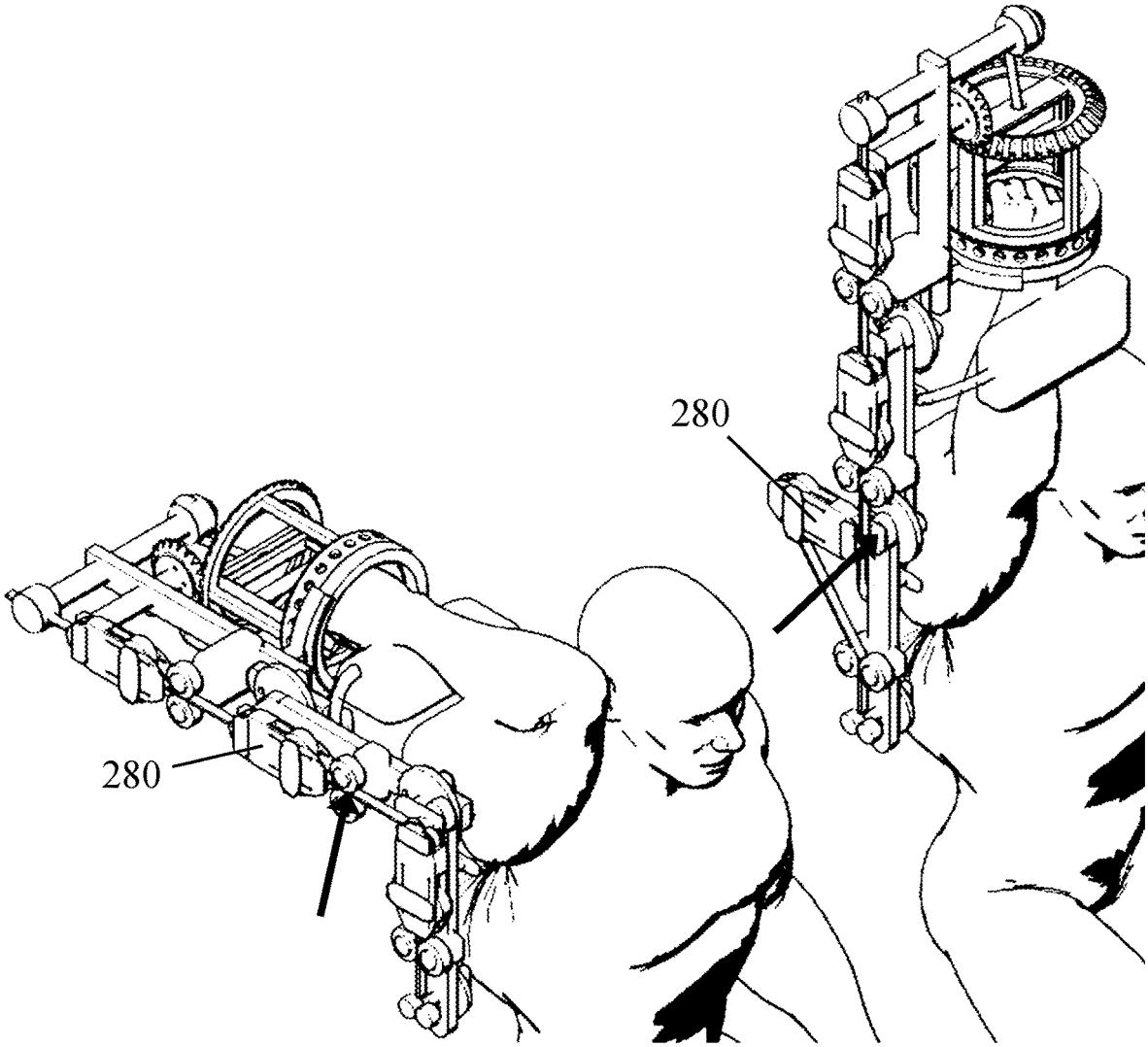

FIG. 14 depicts user operation of an upper extremity exercise apparatus for triceps exercise according to an embodiment.

Figure 15:
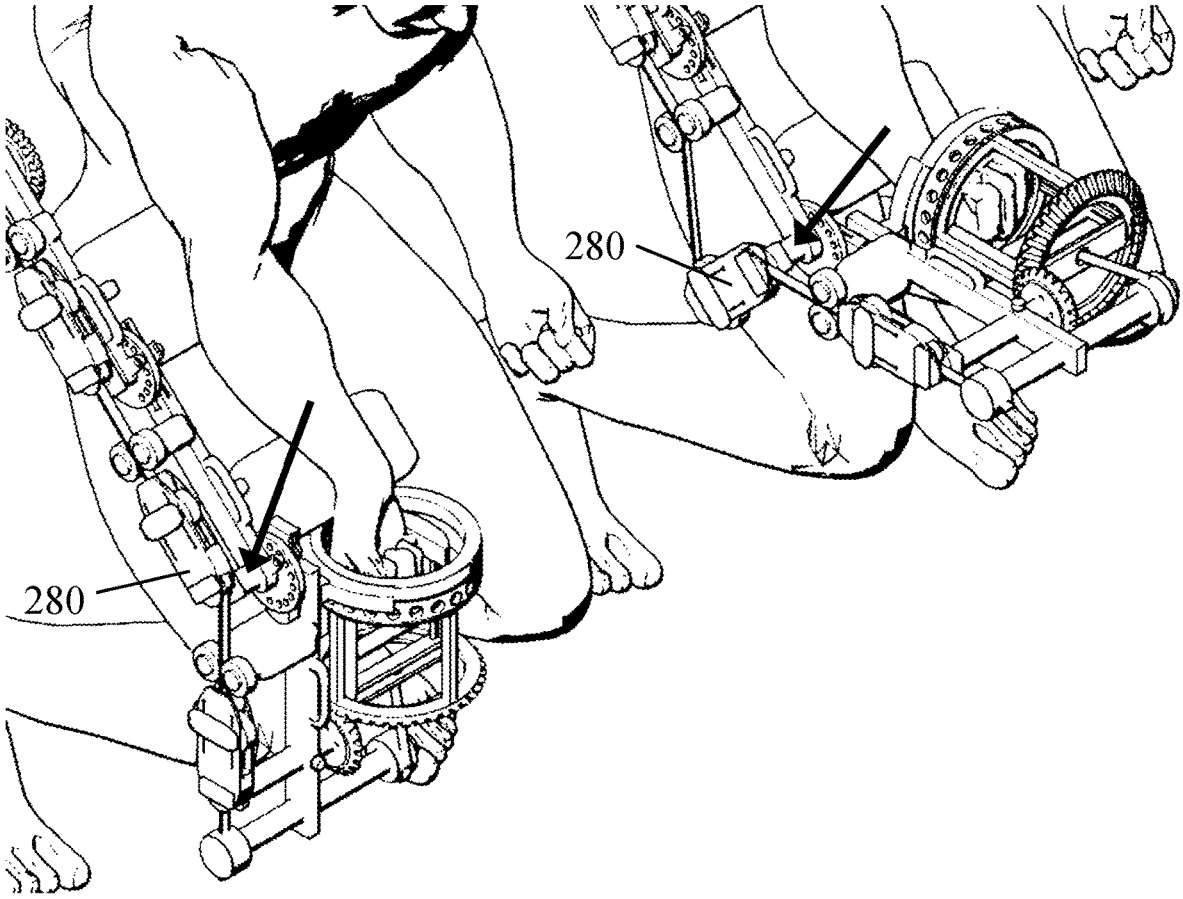

FIG. 15 depicts exercise of the anterior forearm mobilizing cable pull unit of an upper extremity exercise apparatus according to an embodiment.

Figure 16:
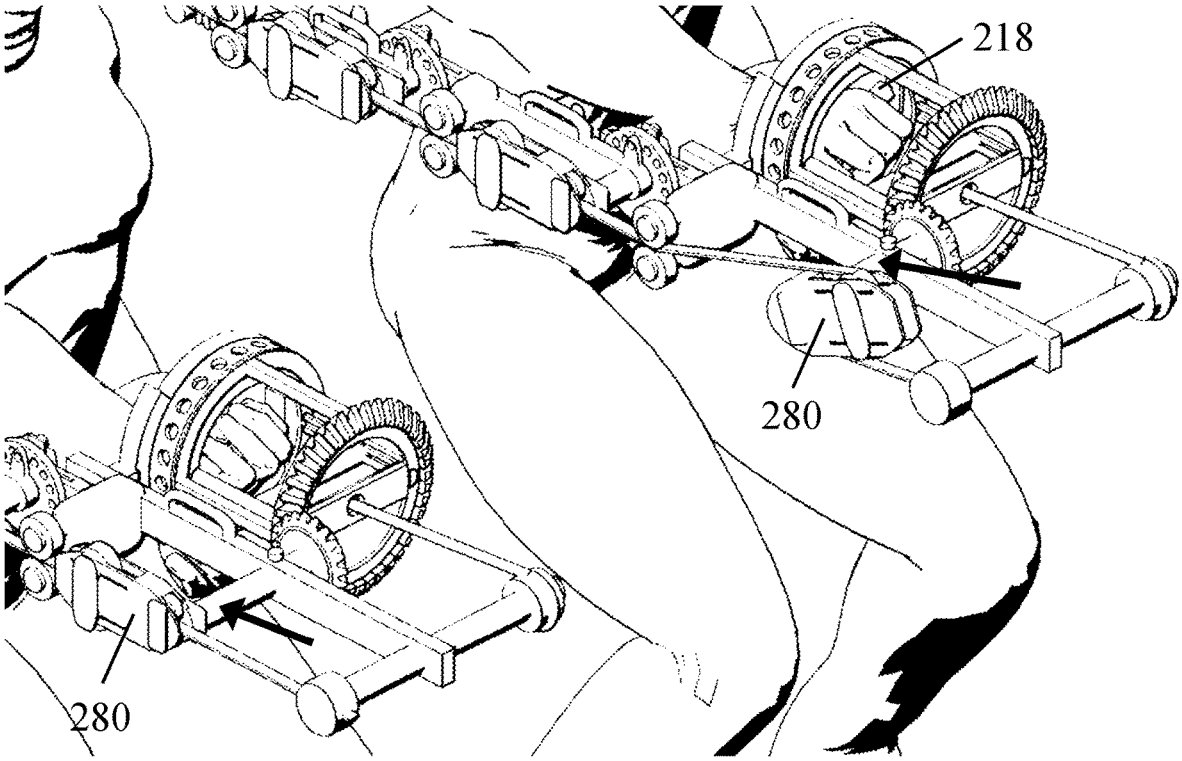

FIG. 16 depicts operation of a cable pull unit of an upper extremity exercise apparatus according to an embodiment.

Figure 17:
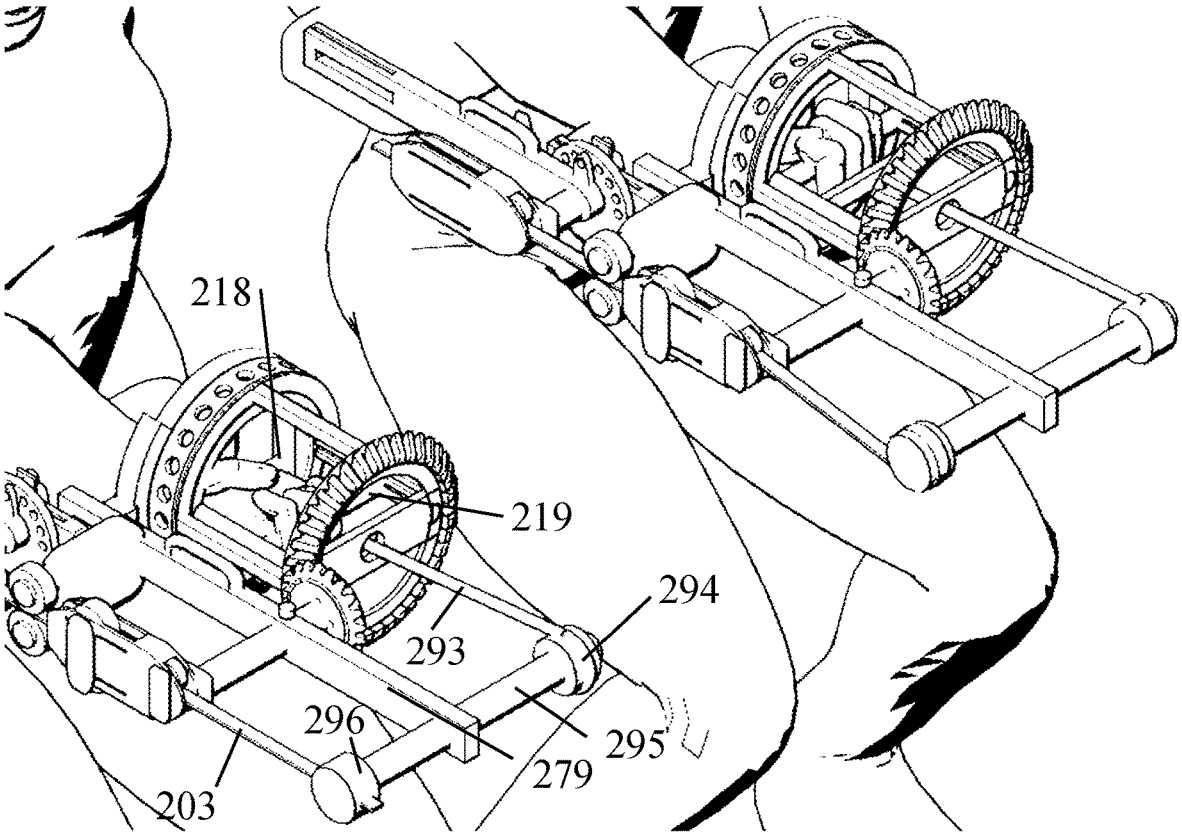

FIG. 17 depicts a start and finish position of a gripping mechanism of an upper extremity exercise apparatus according to an embodiment.

Figure 18:
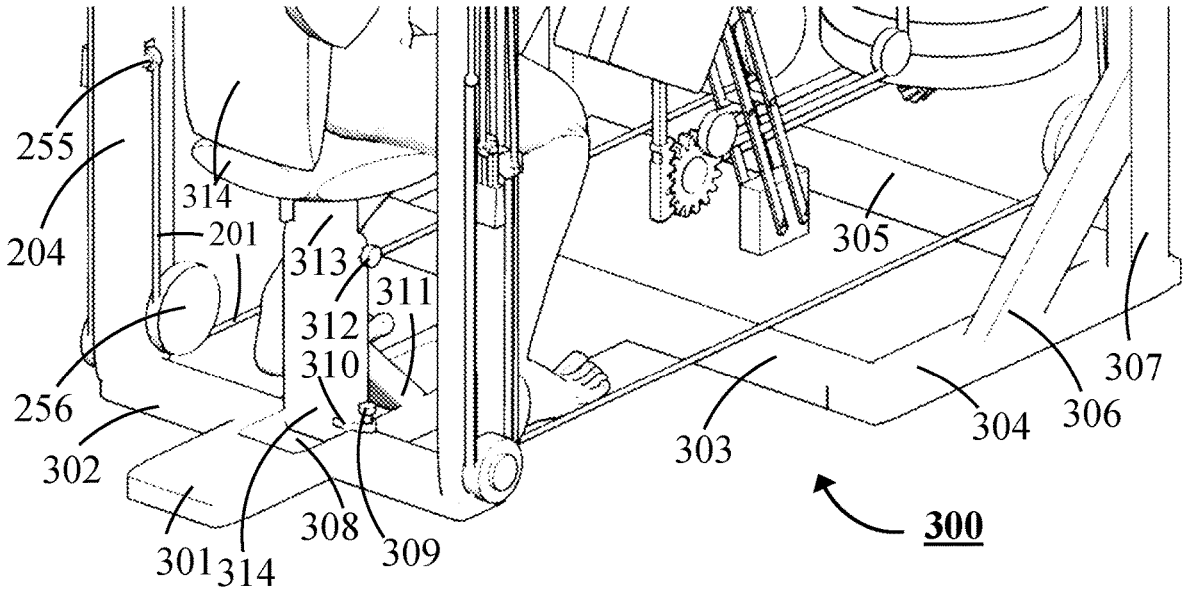

FIG. 18 depicts bilateral, posterior elements of an upper extremity exercise apparatus according to an embodiment.

Figure 19:
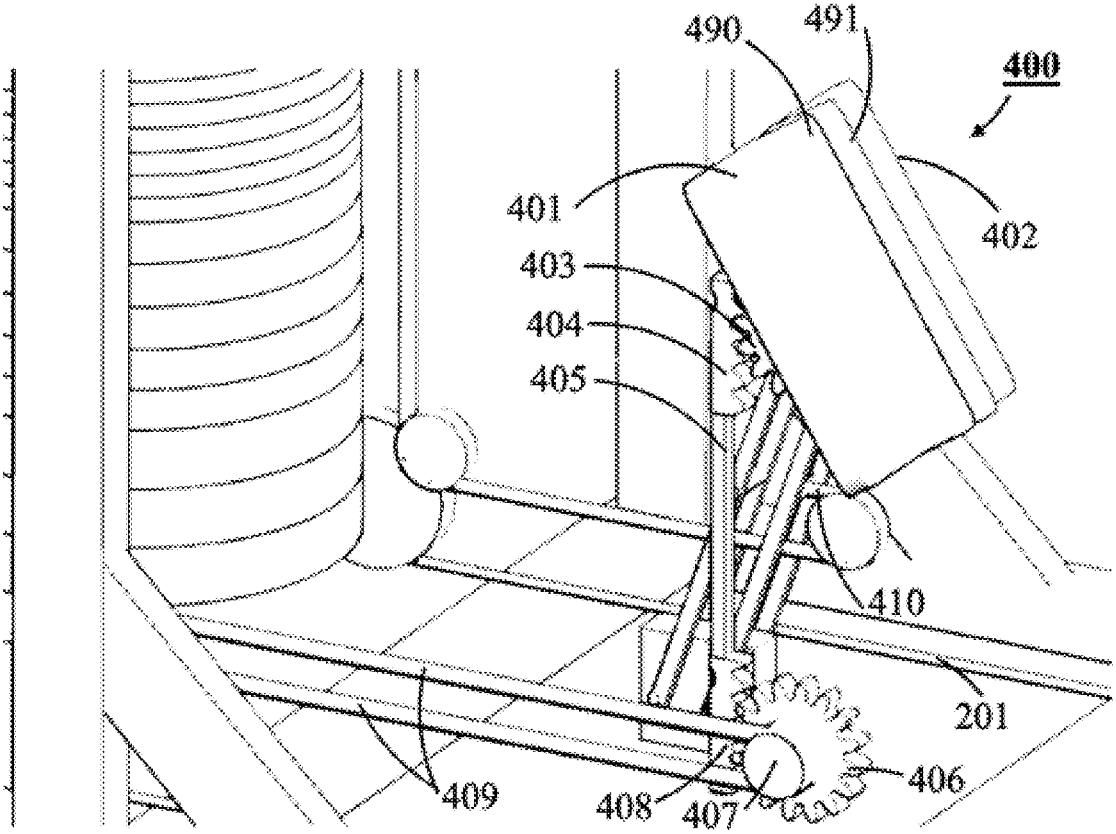

FIG. 19 is a perspective view of a pedal system of an upper extremity exercise apparatus according to an embodiment.

Figure 20:
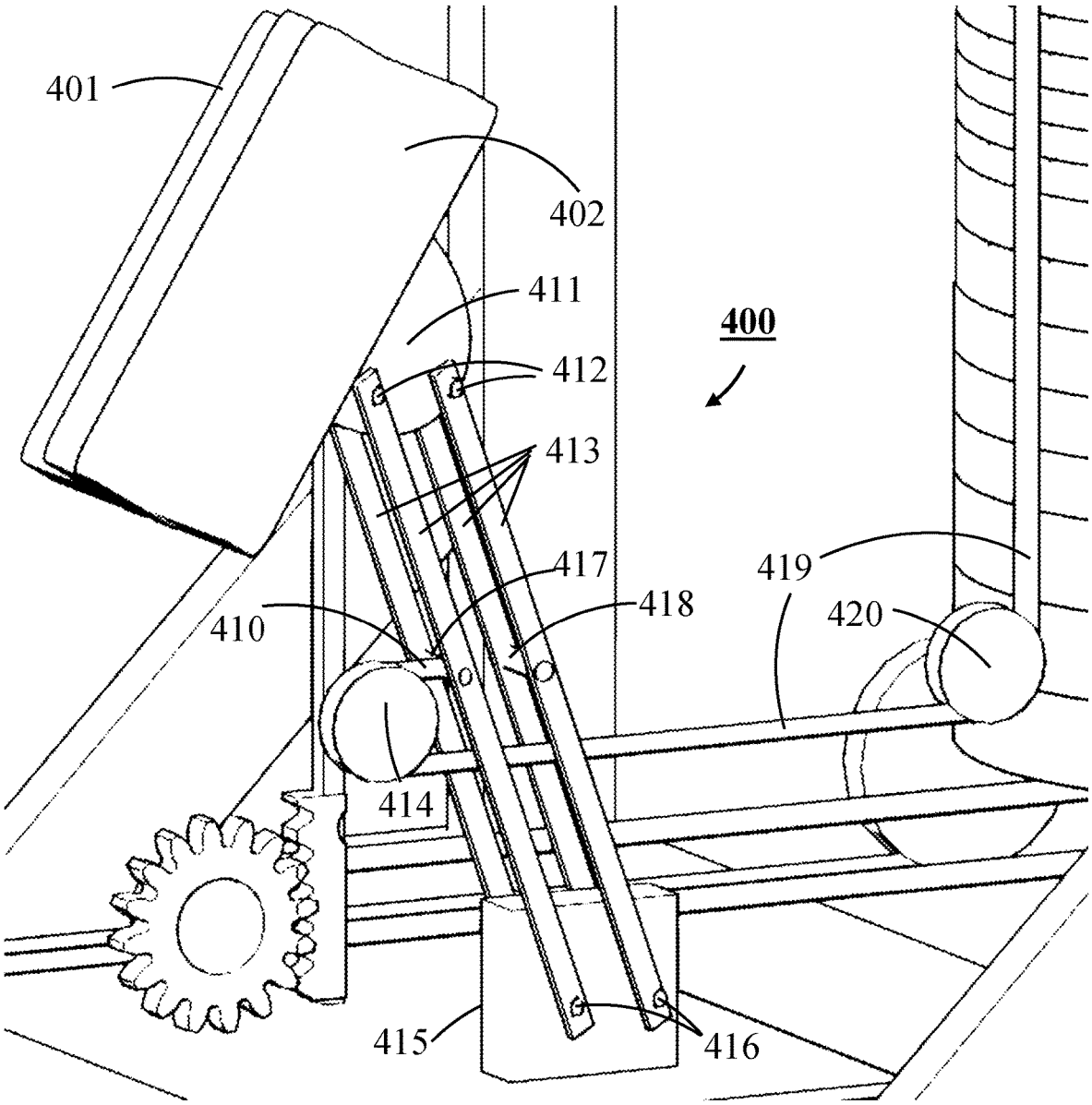

FIG. 20 is a perspective view of a pedal system of an upper extremity exercise apparatus according to an embodiment.

Figure 21A:
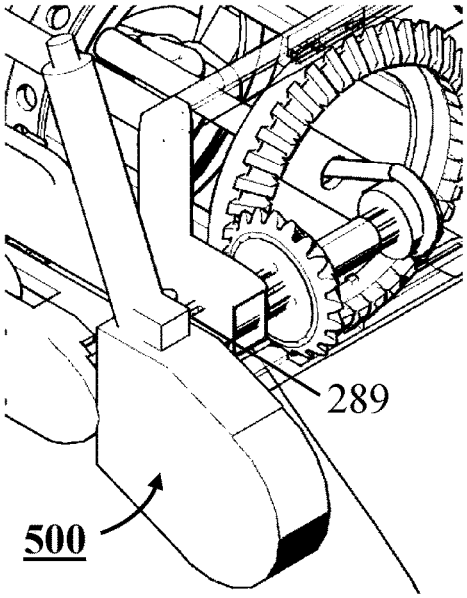

FIG. 21A is a perspective view of a wrist and gripper mechanism of an upper extremity exercise apparatus according to an embodiment.

Figure 21B:
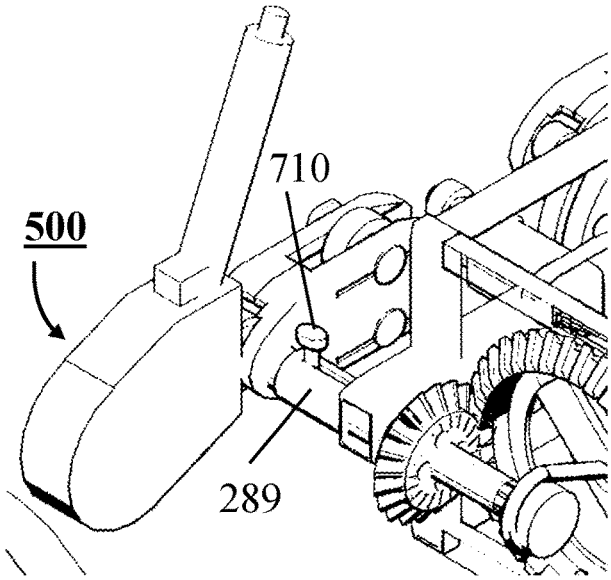

FIG. 21B is a perspective view of a wrist and gripper mechanism of an upper extremity exercise apparatus according to an embodiment.

Figure 21C:
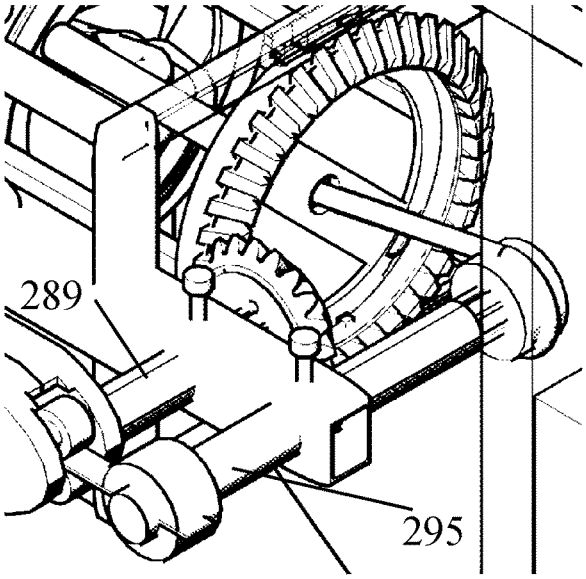

FIG. 21C is a perspective view of a wrist and gripper mechanism of an upper extremity exercise apparatus according to an embodiment.

Figure 22A:
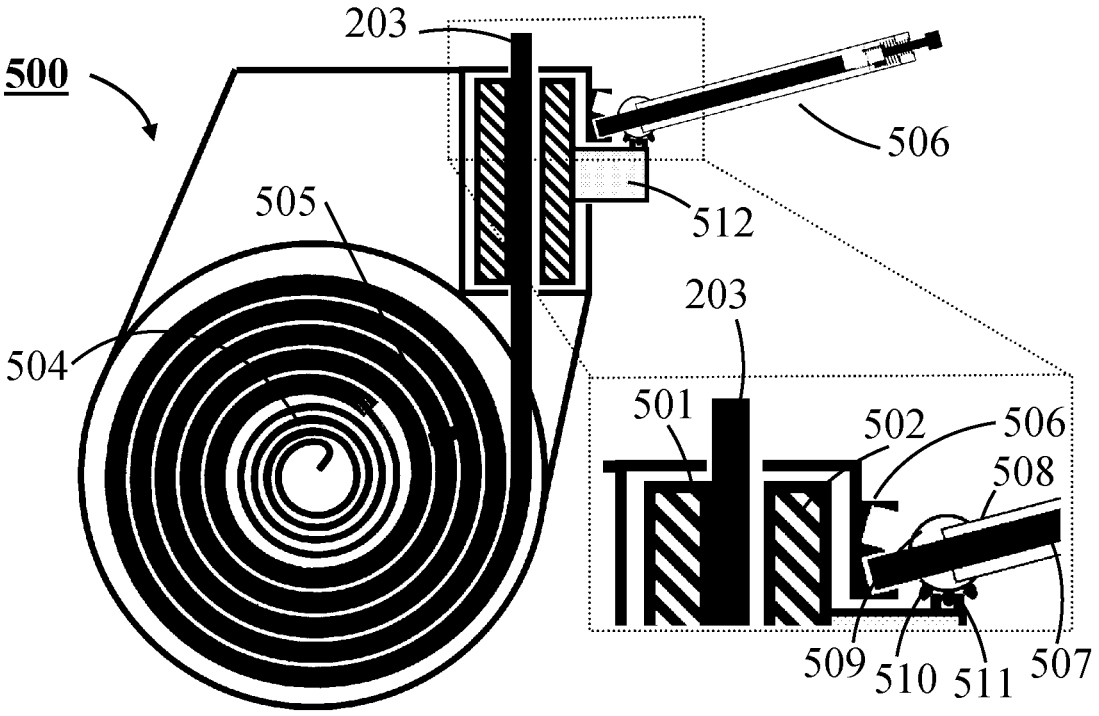

FIG. 22A is a detailed view of a cable slack adjuster of an upper extremity exercise apparatus according to an embodiment.

Figure 22B:
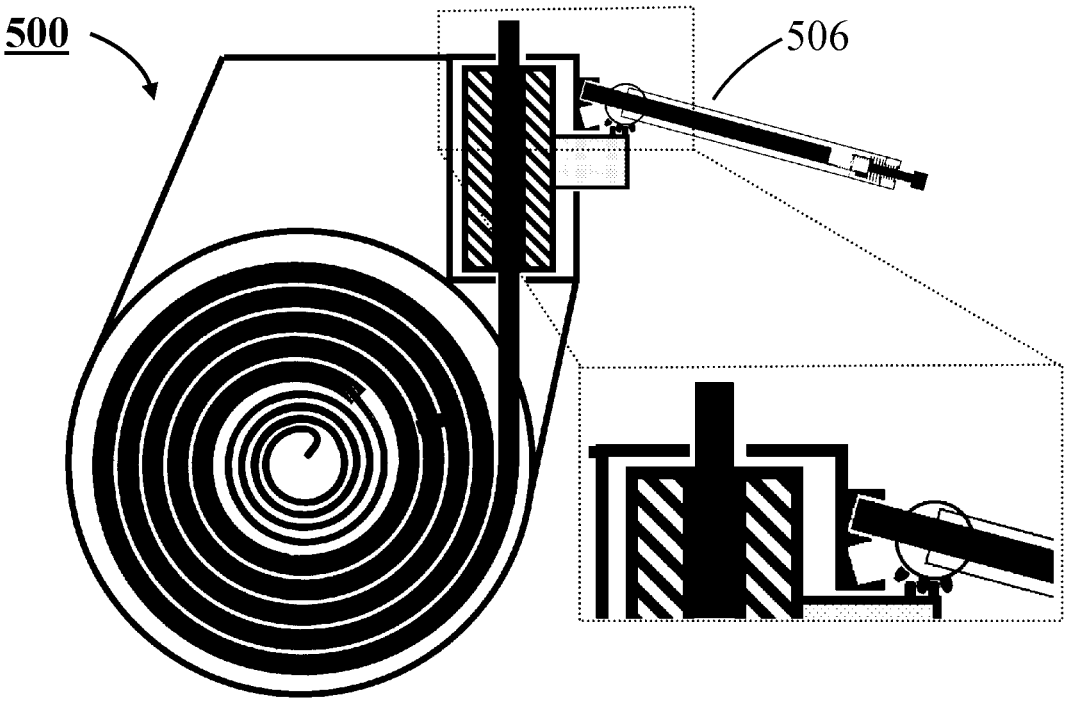

FIG. 22B is a detailed view of a cable slack adjuster of an upper extremity exercise apparatus according to an embodiment.

Figure 23A:
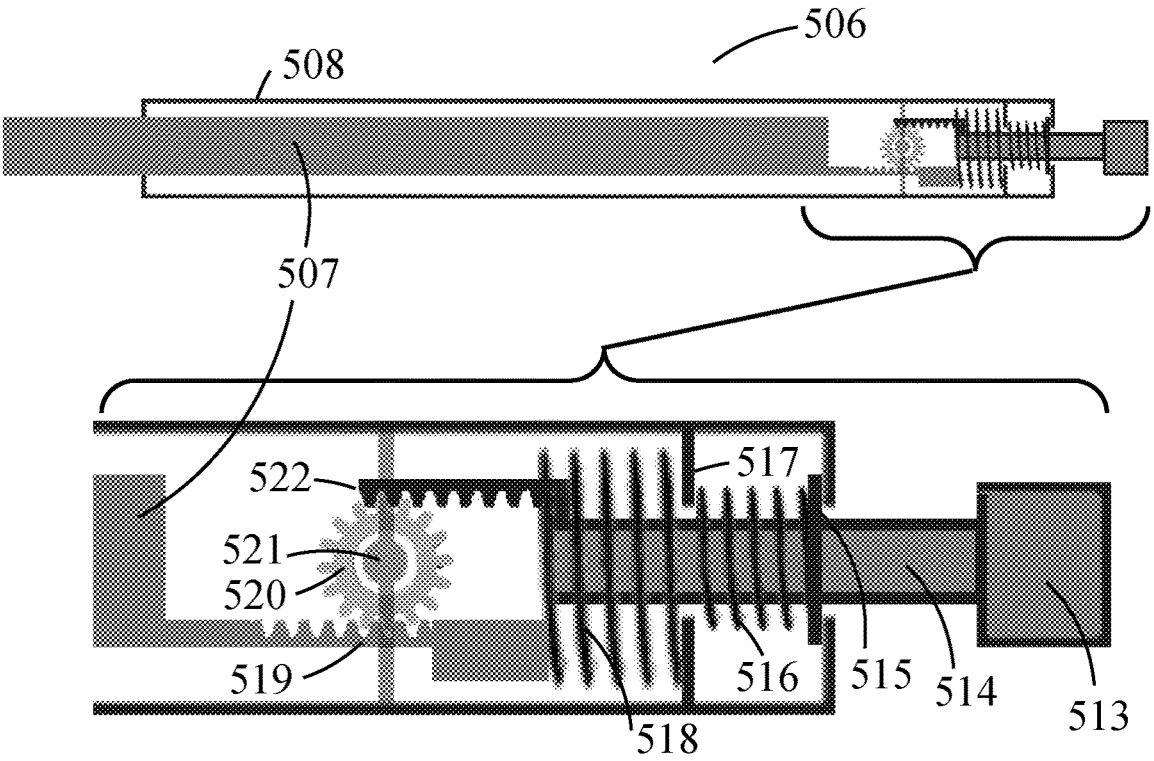

FIG. 23A is a detailed view of a selector pin of a cable slack adjuster of an upper extremity exercise apparatus according to an embodiment.

Figure 23B:
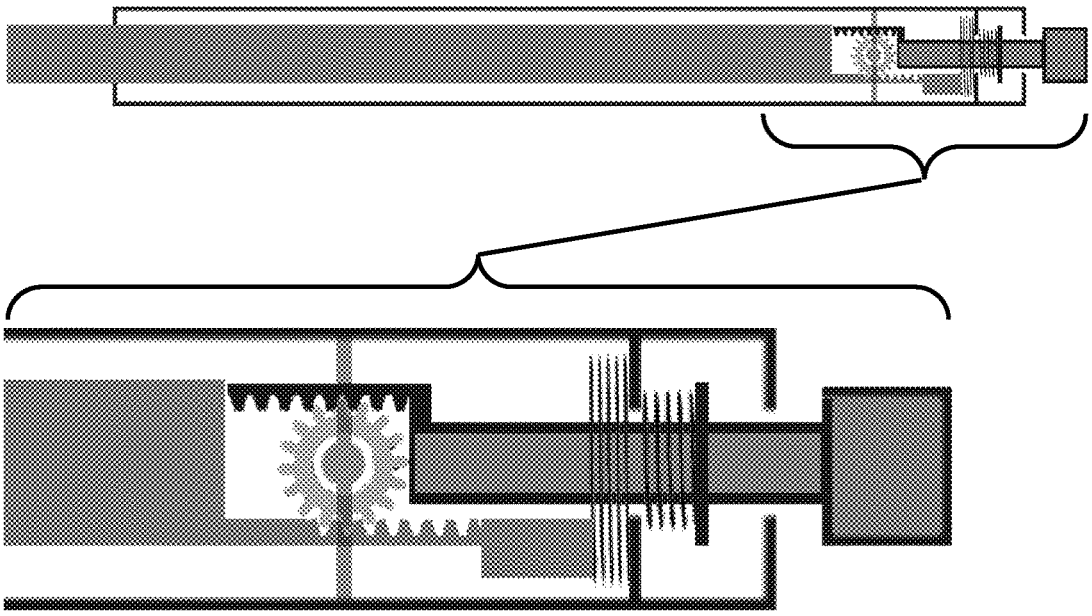

FIG. 23B is a detailed view of a selector pin of a cable slack adjuster of an upper extremity exercise apparatus according to an embodiment.

Figure 24:
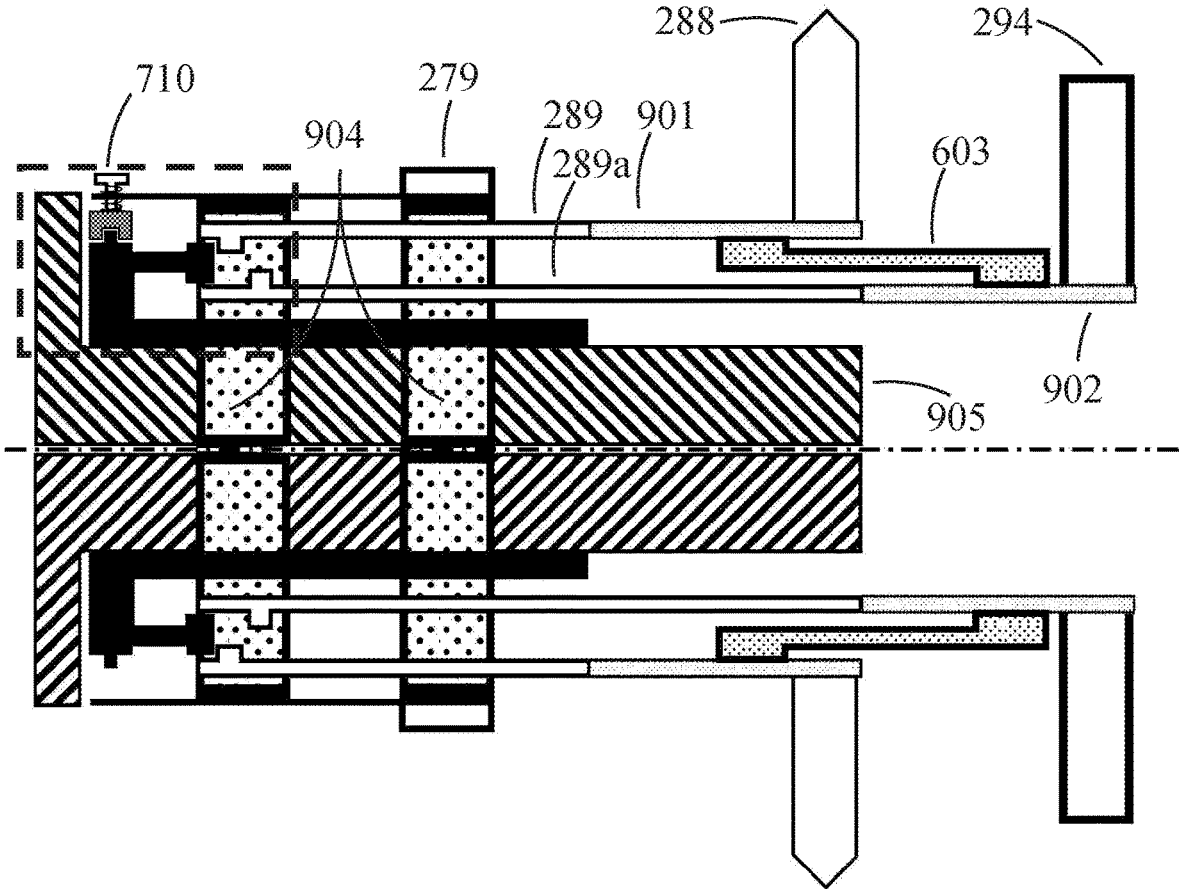

FIG. 24 is a cross-sectional view of a wrist and gripper assembly of an upper extremity exercise apparatus according to an embodiment.

Figure 25A:
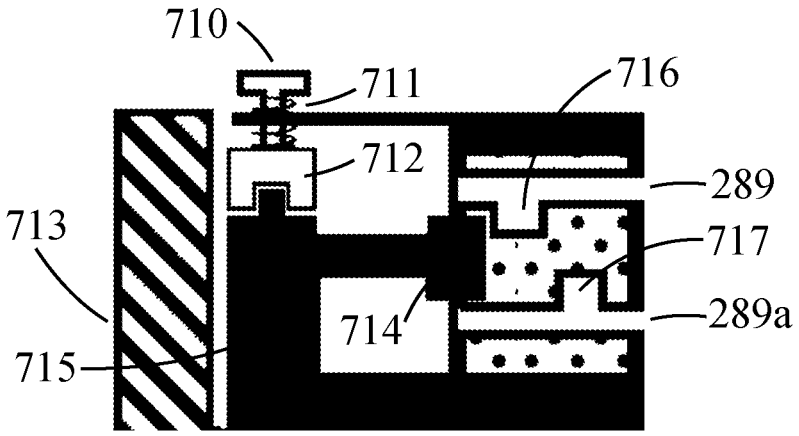
Figure 25B:
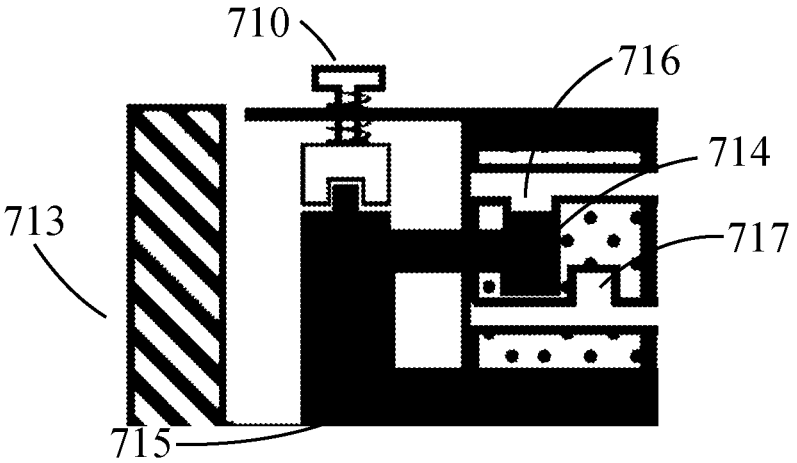
Figure 25C:
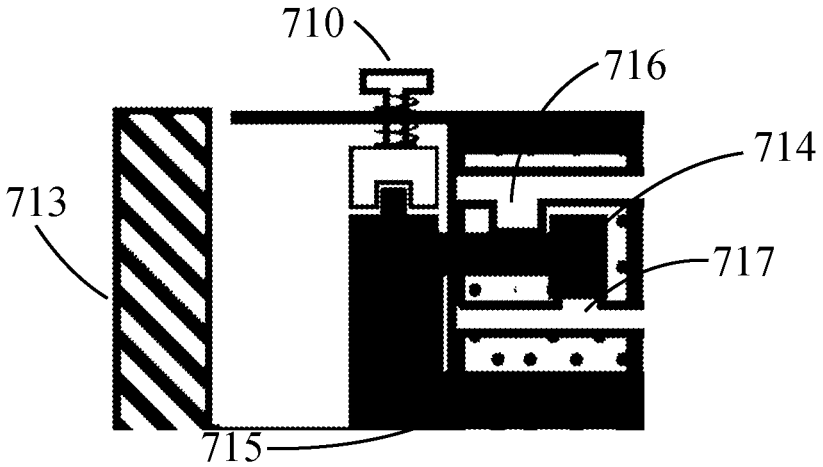

FIGS. 25A, 25B and 25C are detailed views of the slide selector positions of a wrist and gripper assembly of an upper extremity exercise apparatus according to an embodiment.

Figure 26A:
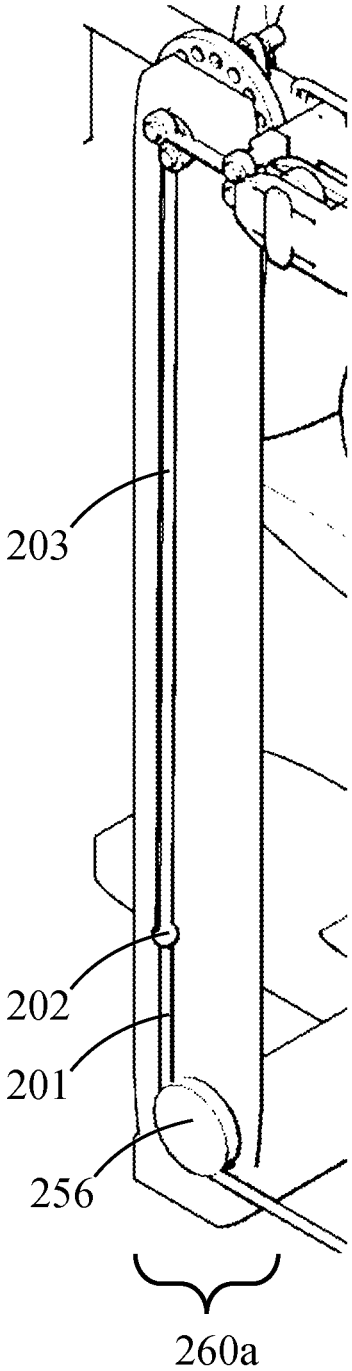
Figure 26B:
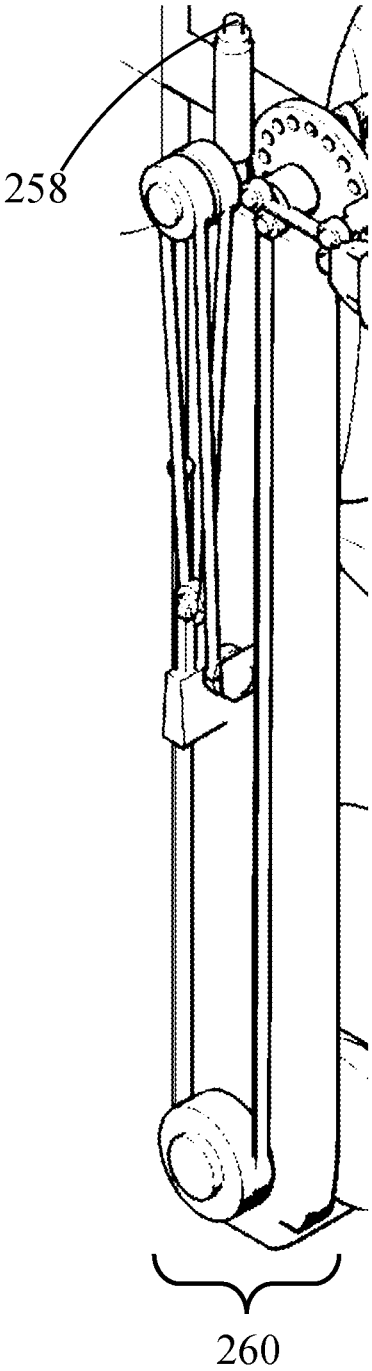

FIGS. 26A and 26B are perspective views of a cable converter of an upper extremity exercise apparatus according to an embodiment.

Figure 27:
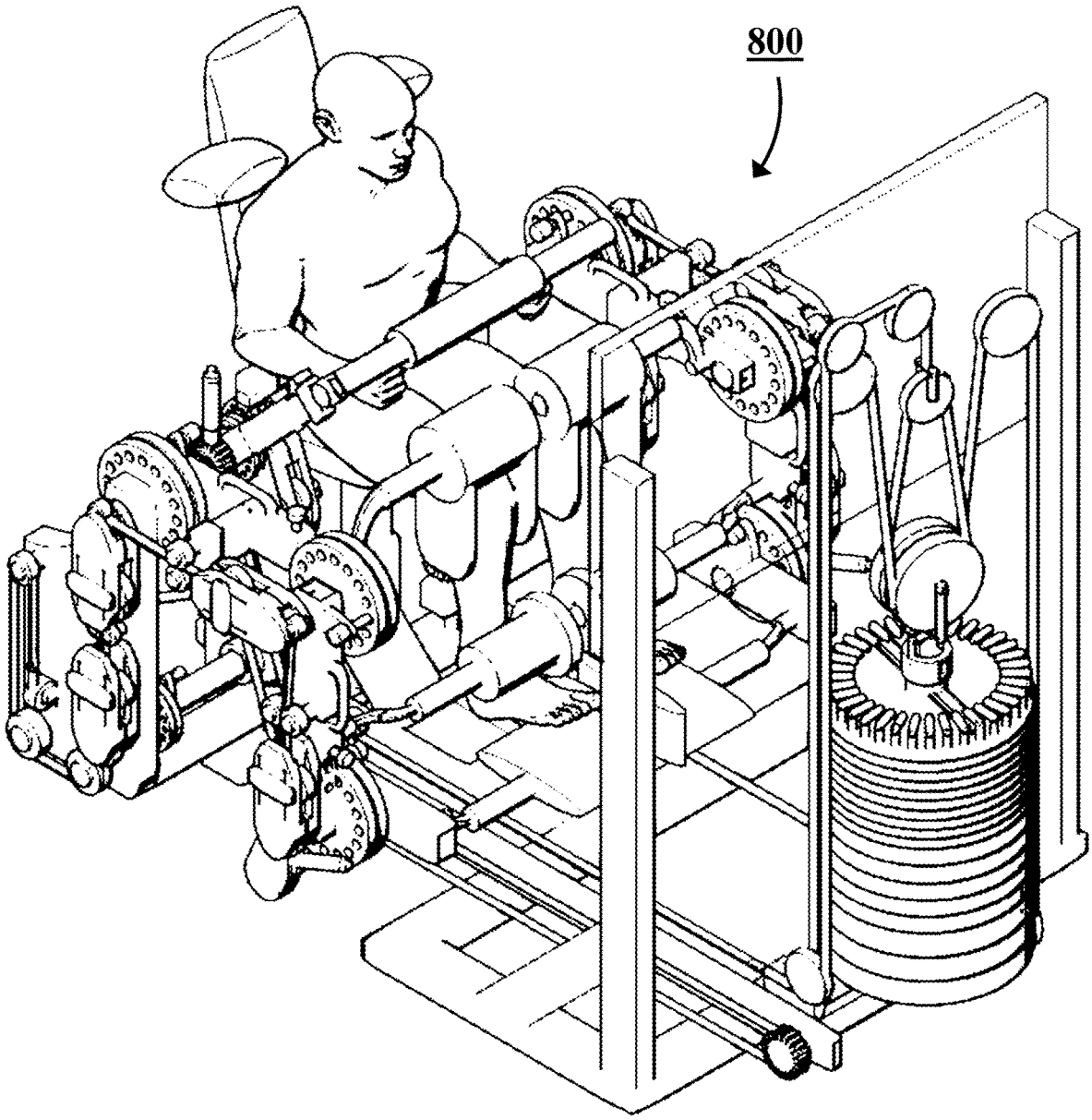

FIG. 27 is a perspective view of a lower extremity and core exercise apparatus according to an embodiment.

Figure 28:
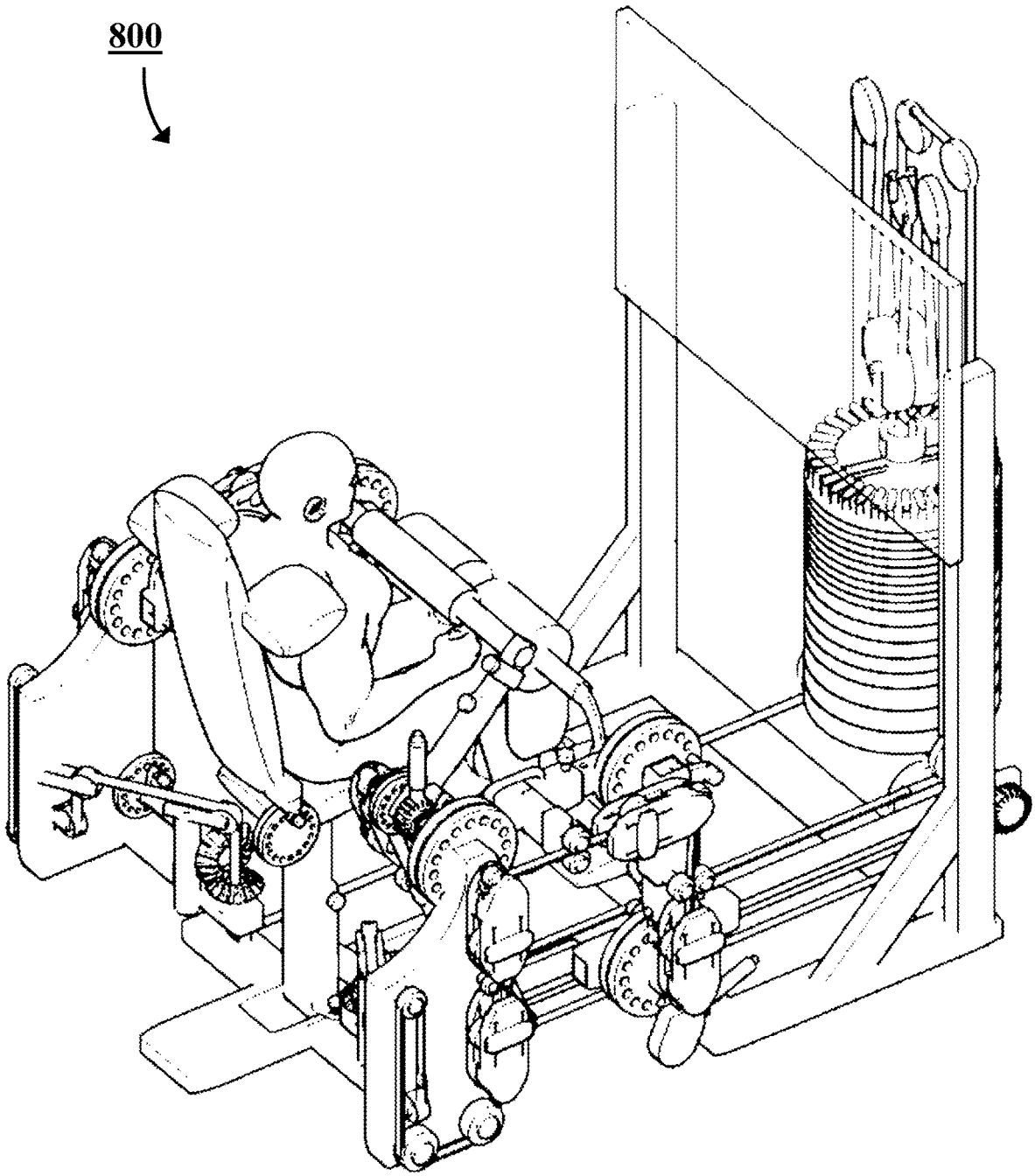

FIG. 28 is a perspective view of a lower extremity and core exercise apparatus according to an embodiment.

Figure 29:
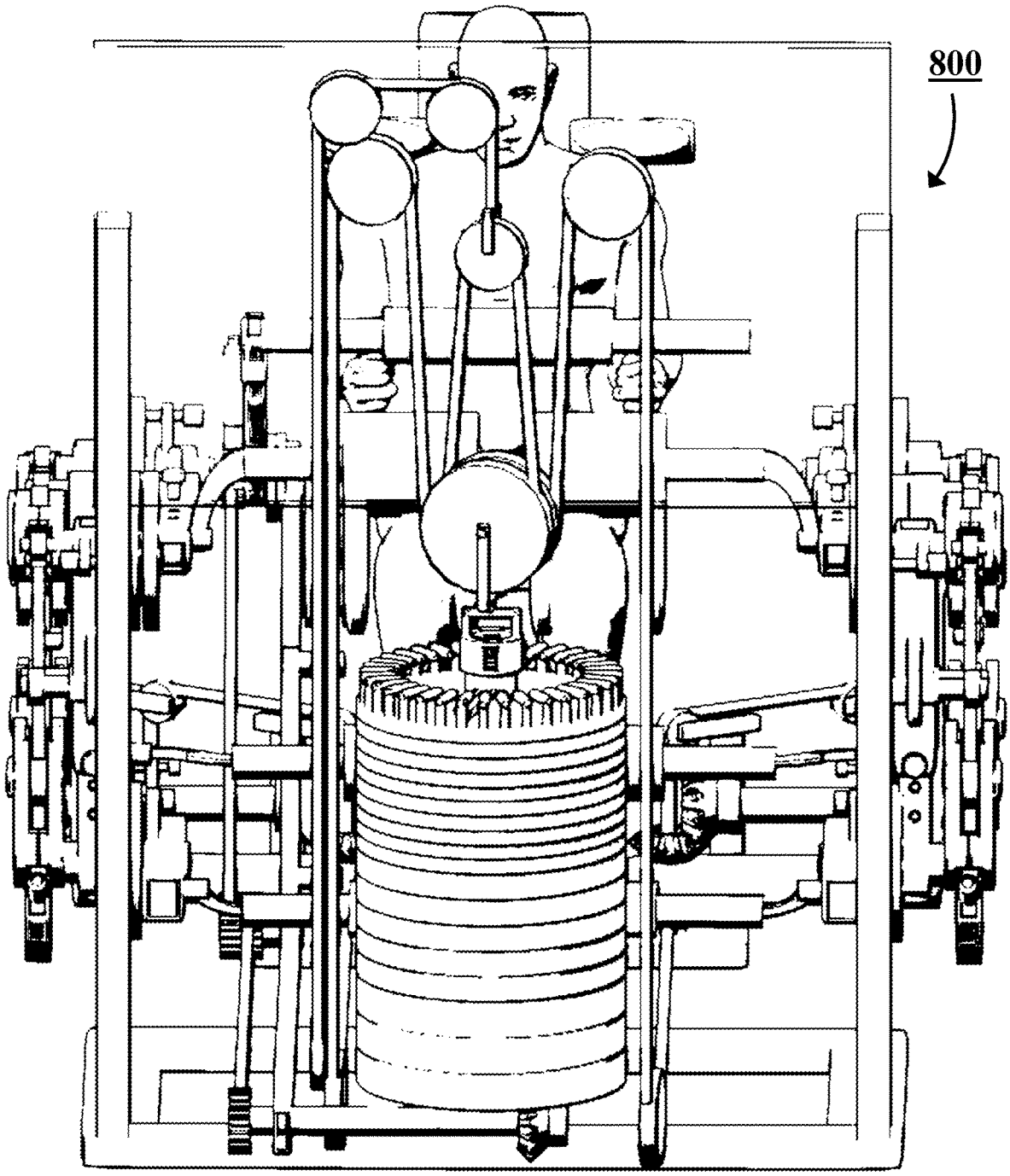

FIG. 29 is a perspective view of a lower extremity and core exercise apparatus according to an embodiment.

Figure 30:
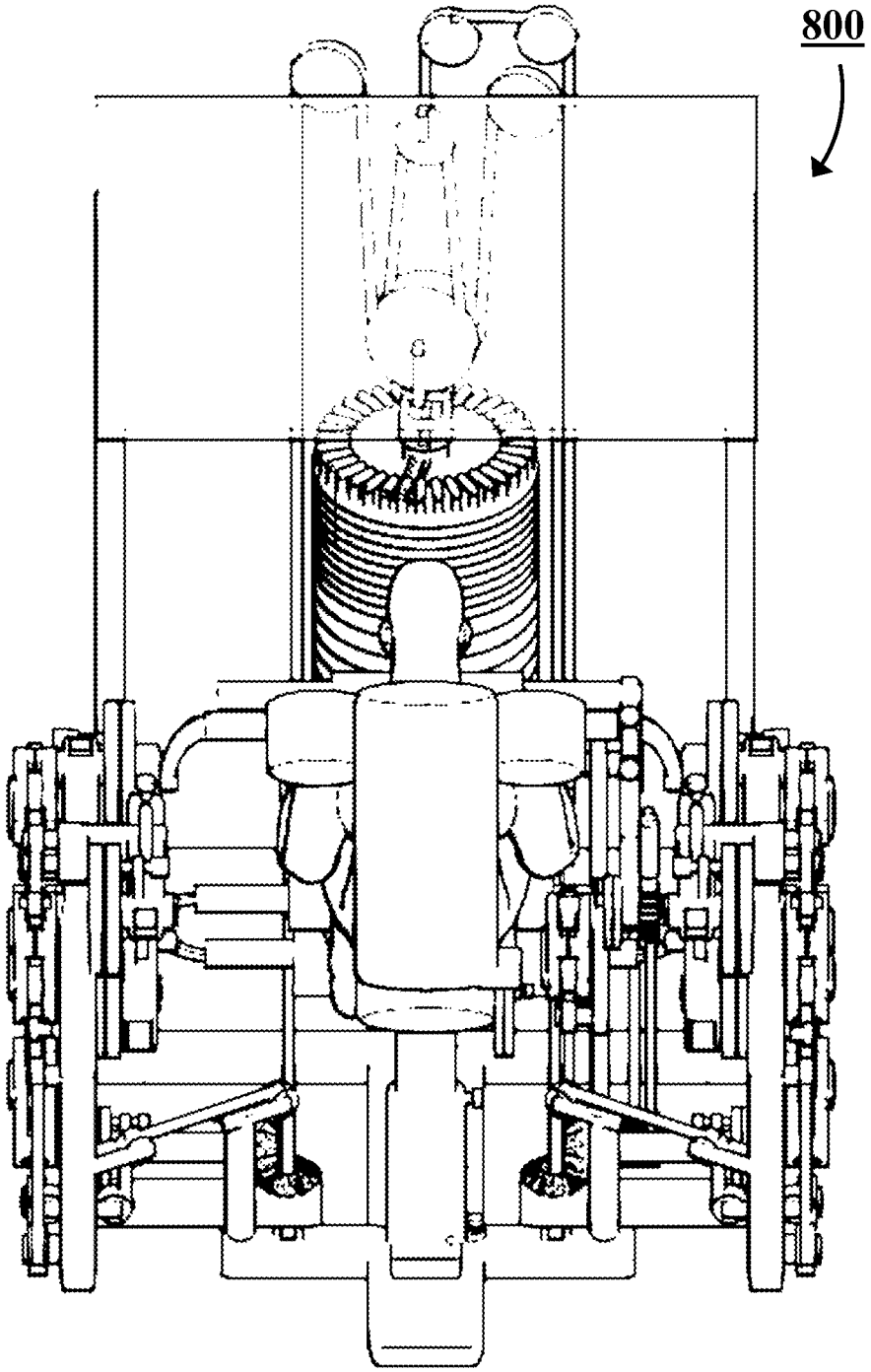

FIG. 30 is a perspective view of a lower extremity and core exercise apparatus according to an embodiment.

Figure 31A:
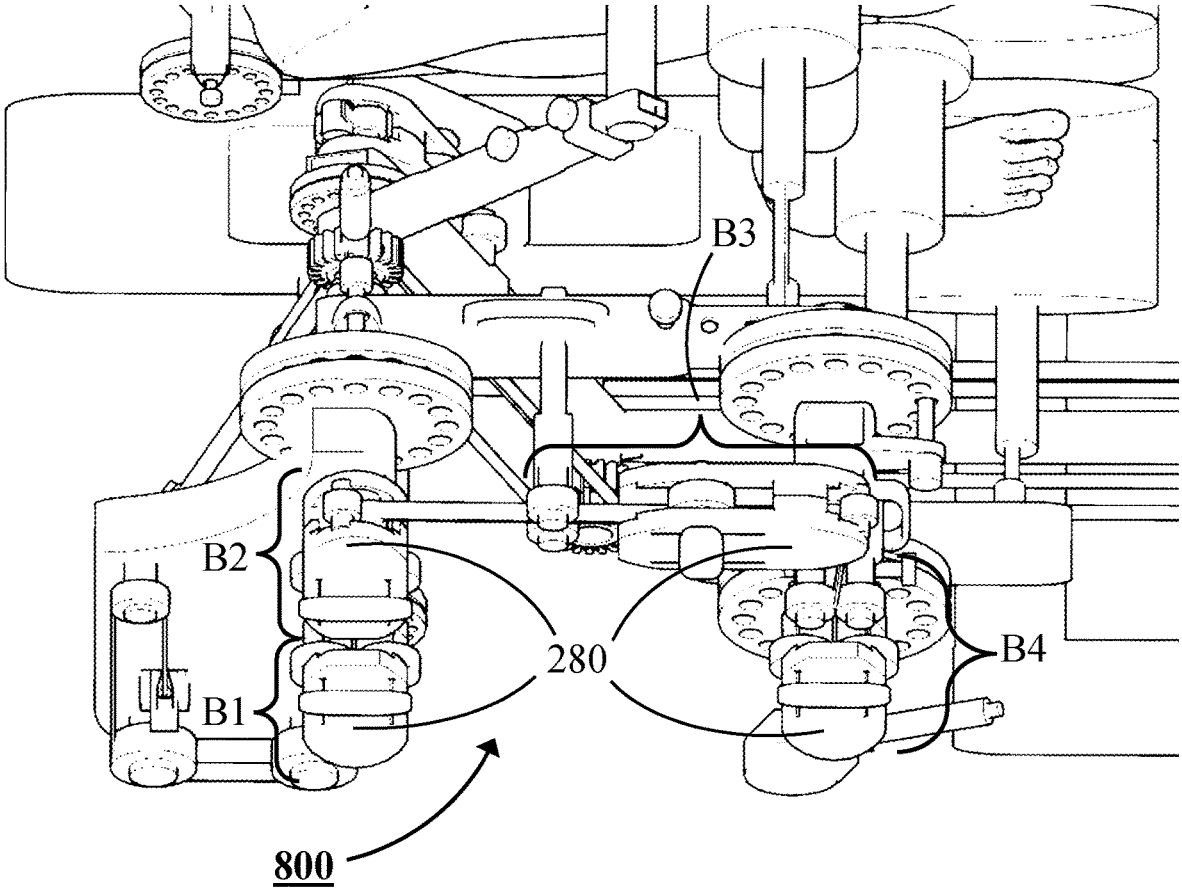

FIG. 31A is a perspective view of a proximal portion of a right sided lower extremity and core exercise apparatus according to an embodiment.

Figure 31B:
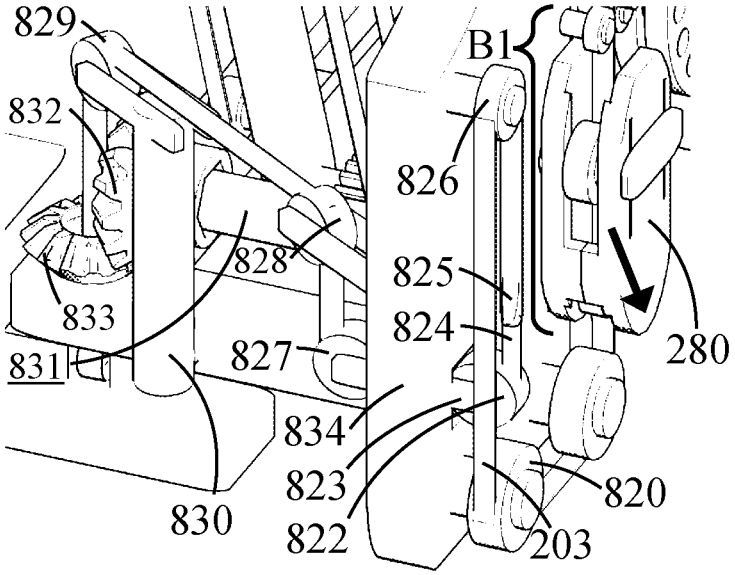

FIG. 31B is a perspective view of a proximal portion of a right sided lower extremity and core exercise apparatus according to an embodiment.

Figure 32A:
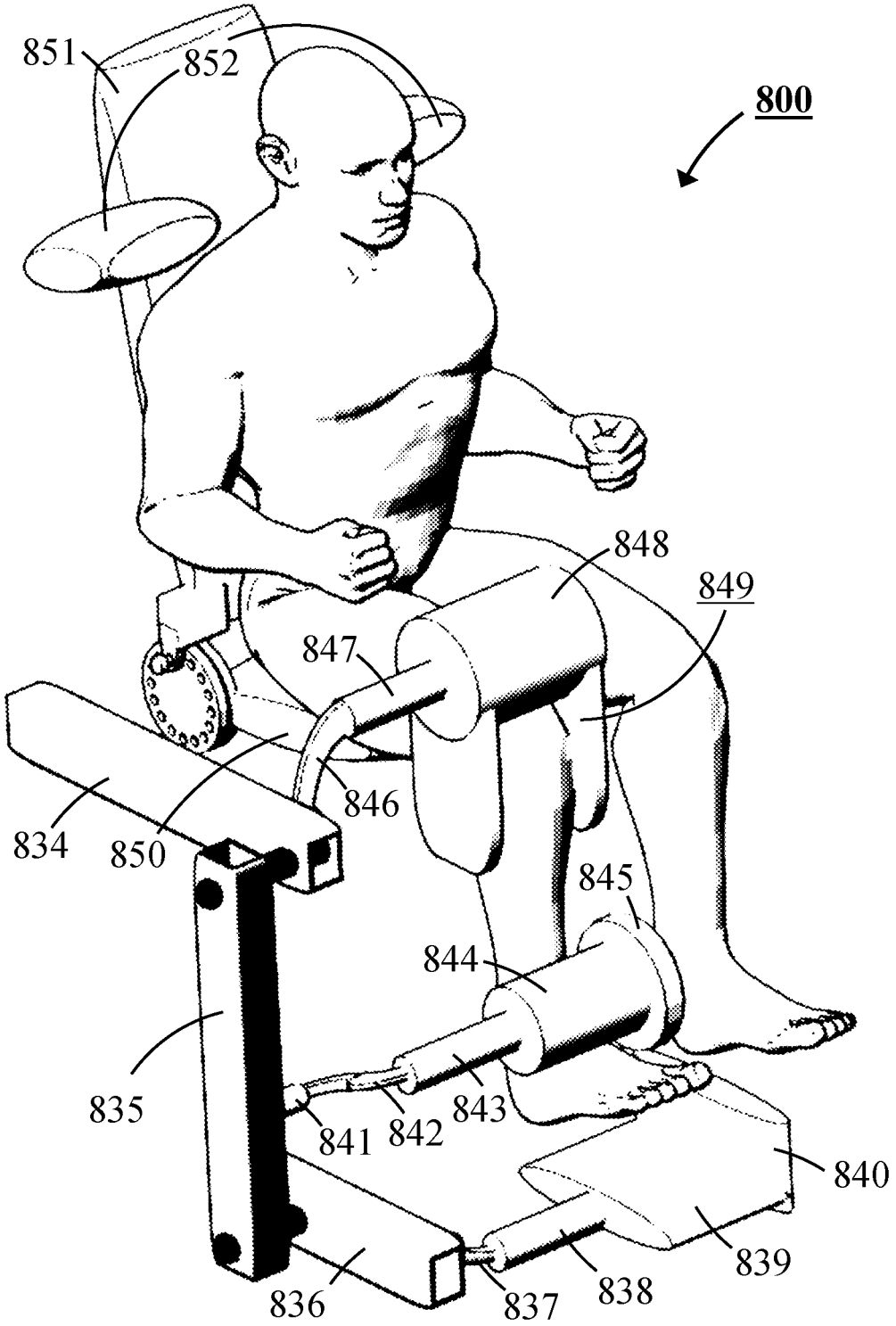

FIG. 32A is a perspective view of a support pad system of a lower extremity and core exercise apparatus according to an embodiment.

Figure 32B:
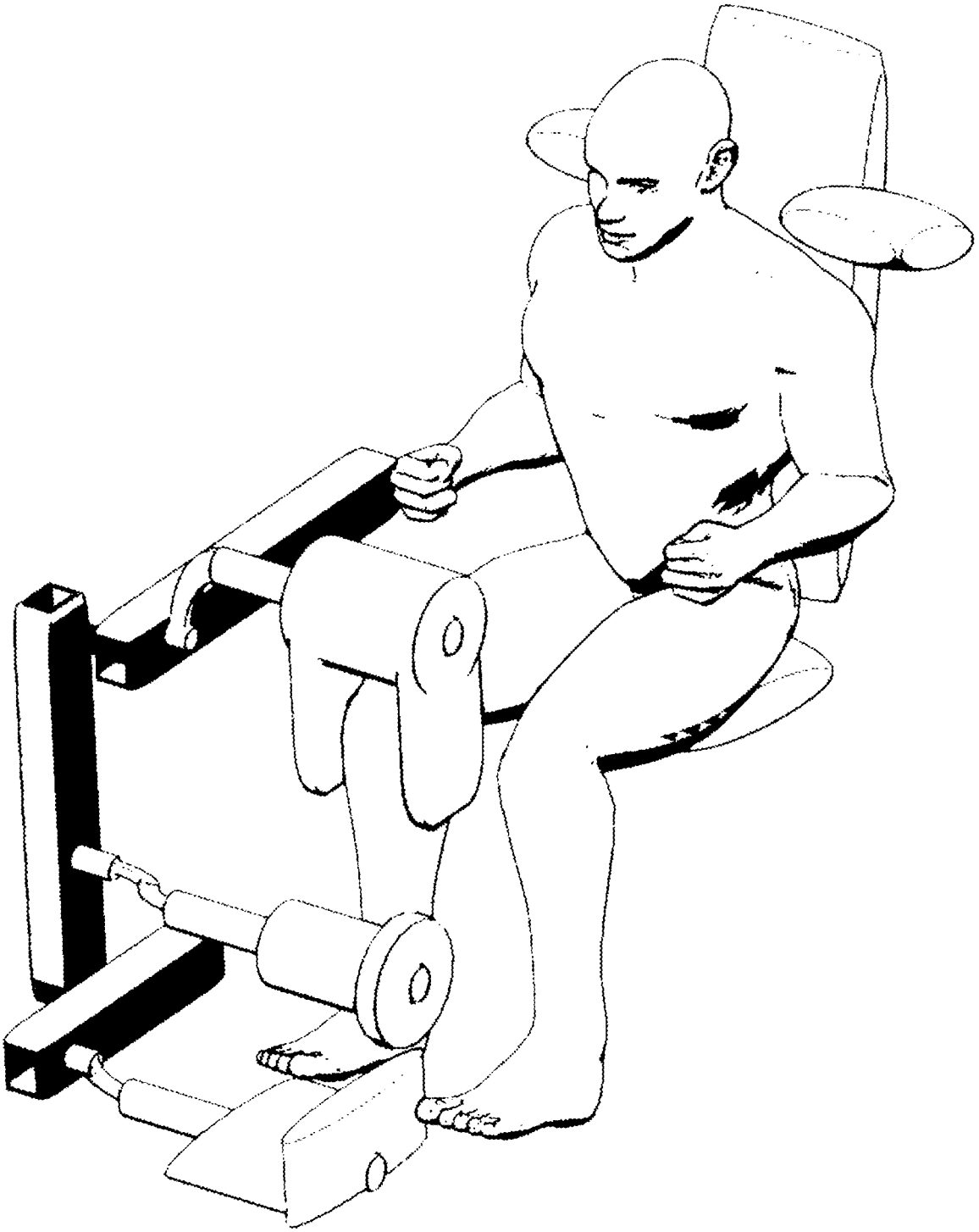

FIG. 32B is a perspective view of a support pad system of a lower extremity and core exercise apparatus according to an embodiment.

Figure 32C:
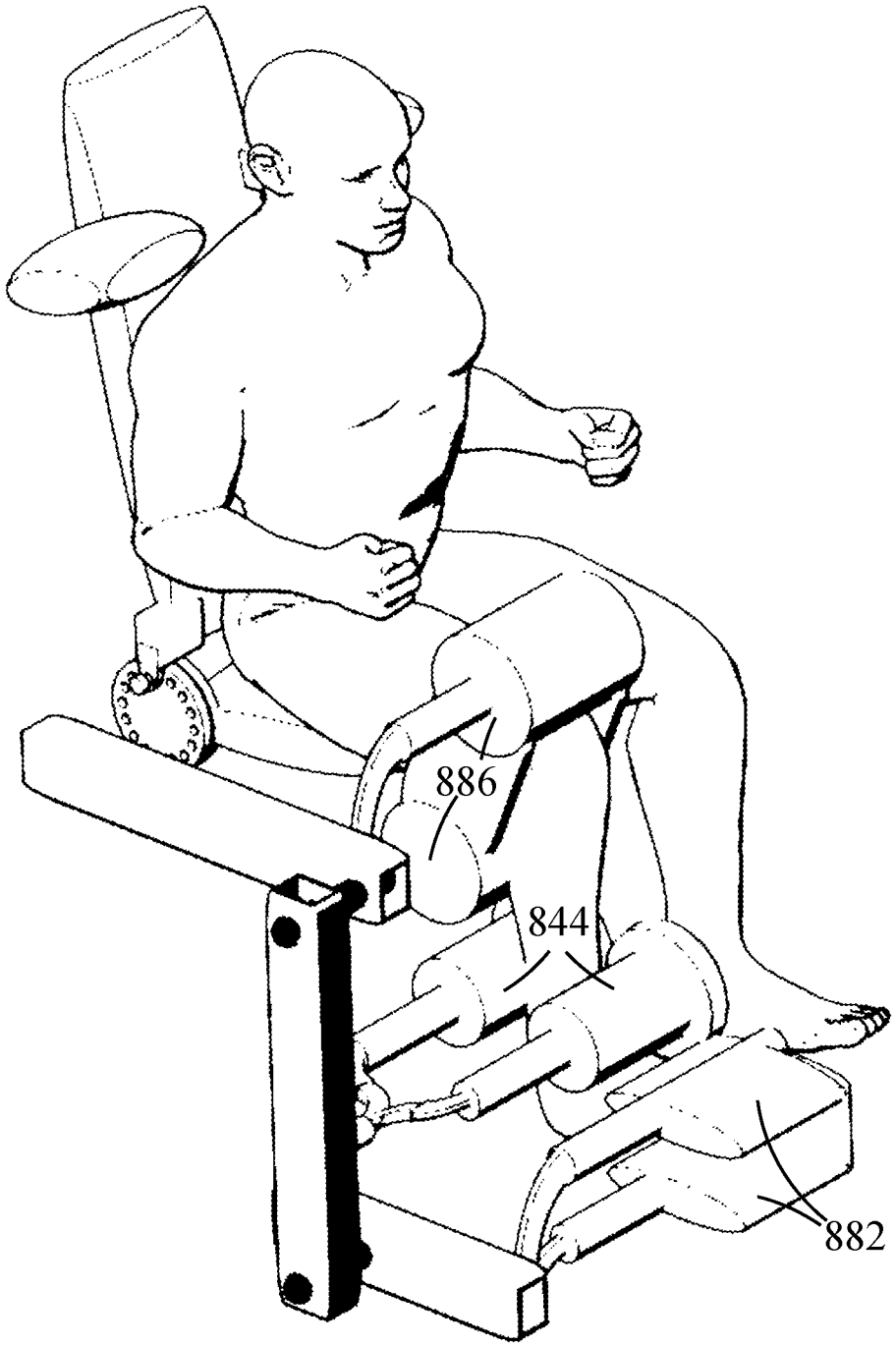

FIG. 32C is a perspective view of a support pad system of a lower extremity and core exercise apparatus according to an embodiment.

Figure 32D:
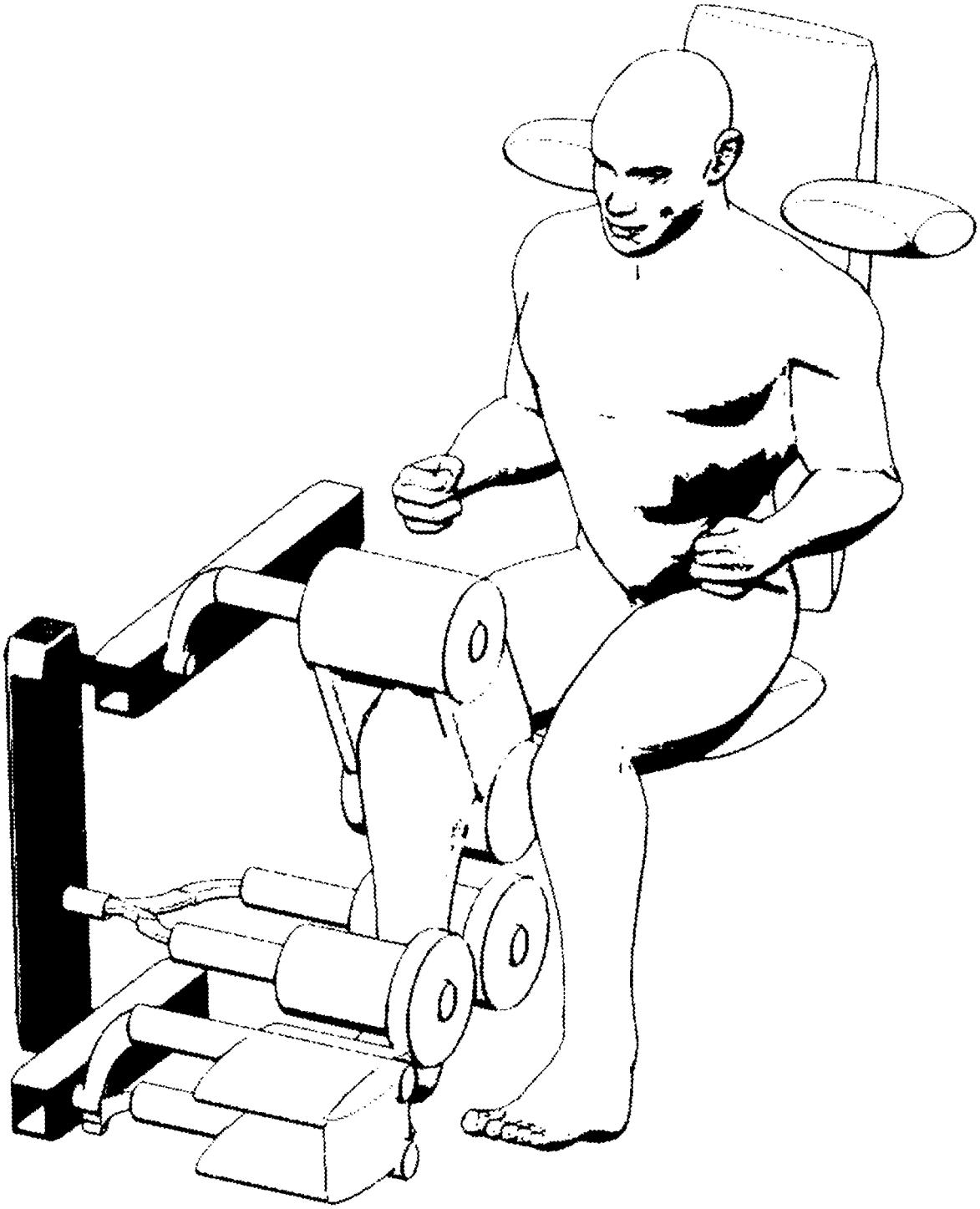

FIG. 32D is a perspective view of a support pad system of a lower extremity and core exercise apparatus according to an embodiment.

Figure 33A:
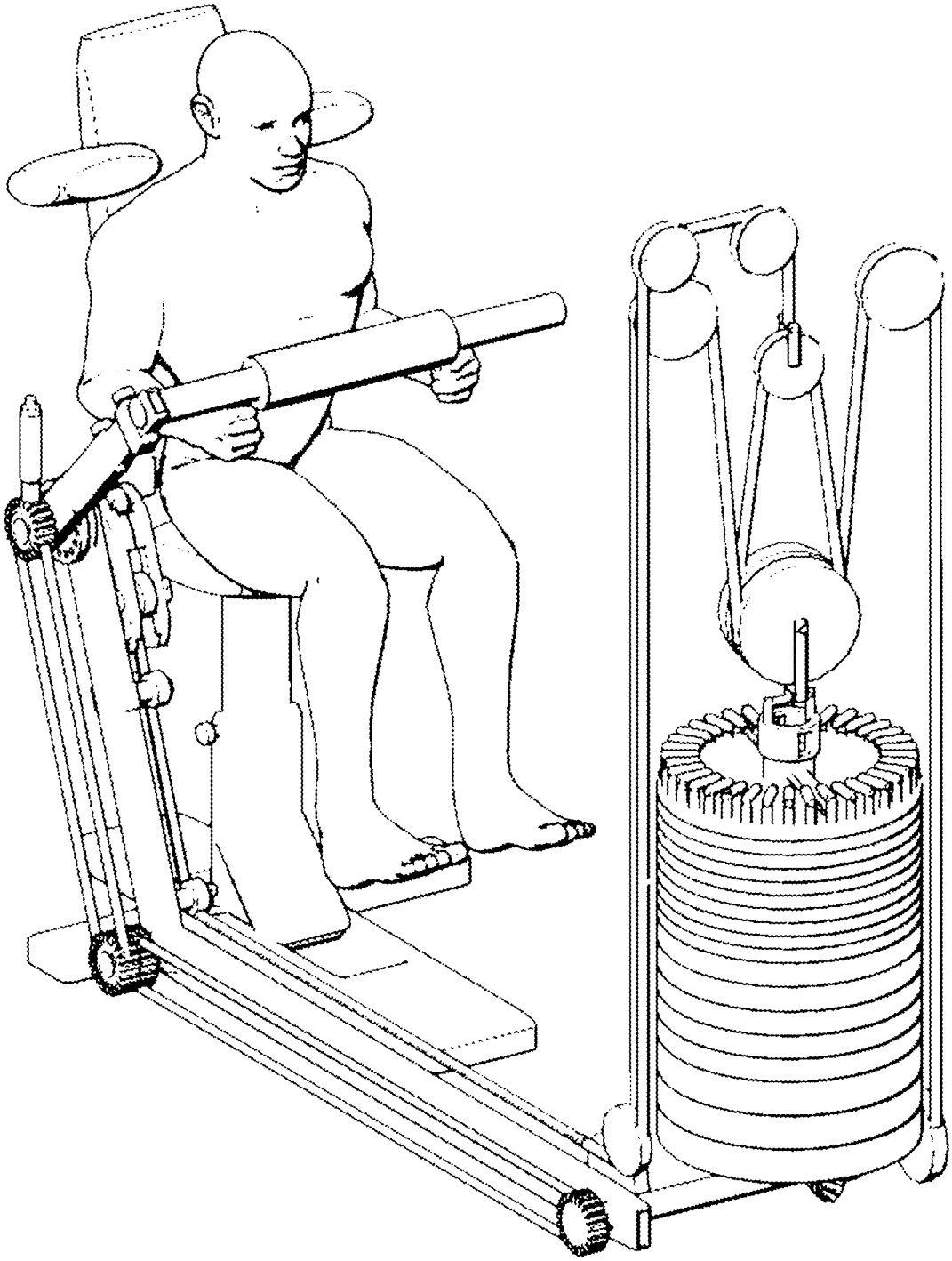

FIG. 33A is a perspective views of a weight selection assembly and weight assist/midsection assembly of a lower extremity and core exercise apparatus according to an embodiment.

Figure 33B:
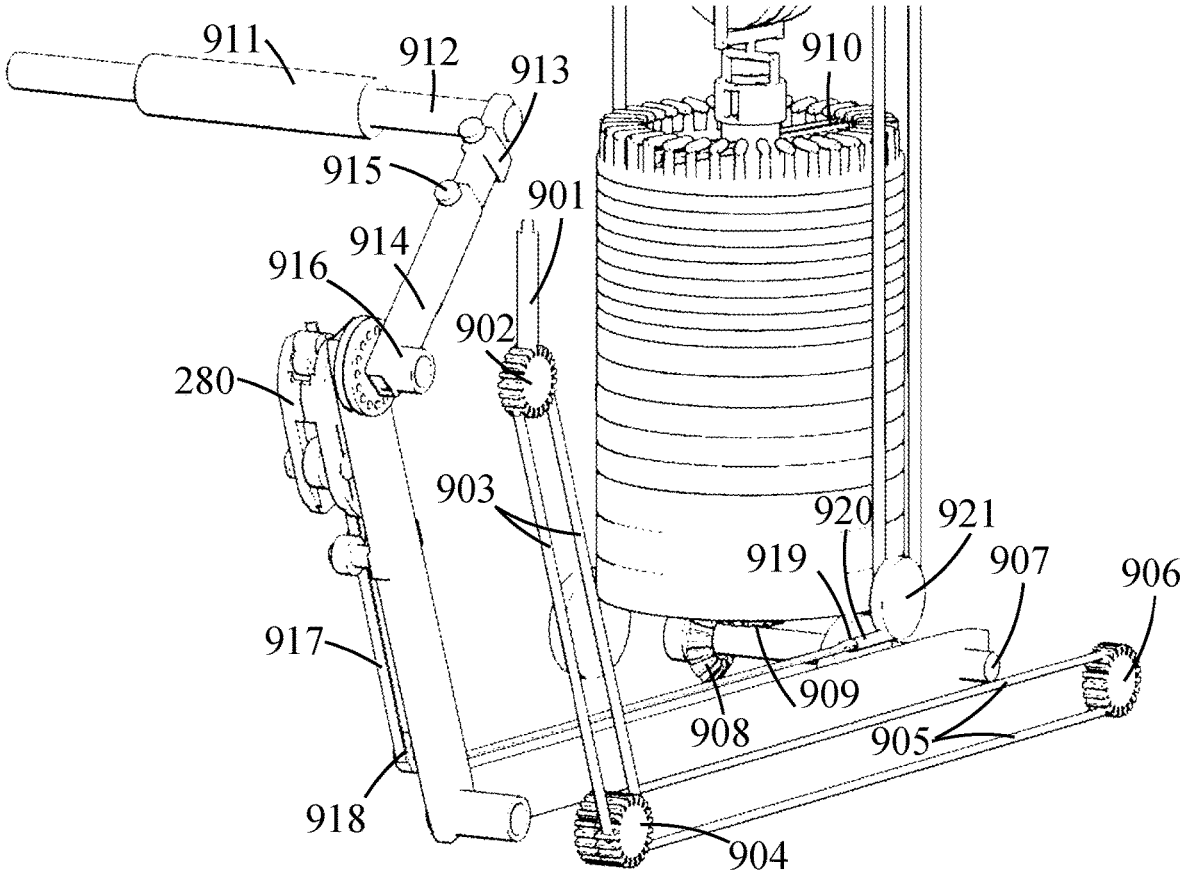

FIG. 33B is a perspective view of a weight selection assembly and weight assist/midsection assembly of a lower extremity and core exercise apparatus according to an embodiment.

Figure 34A:
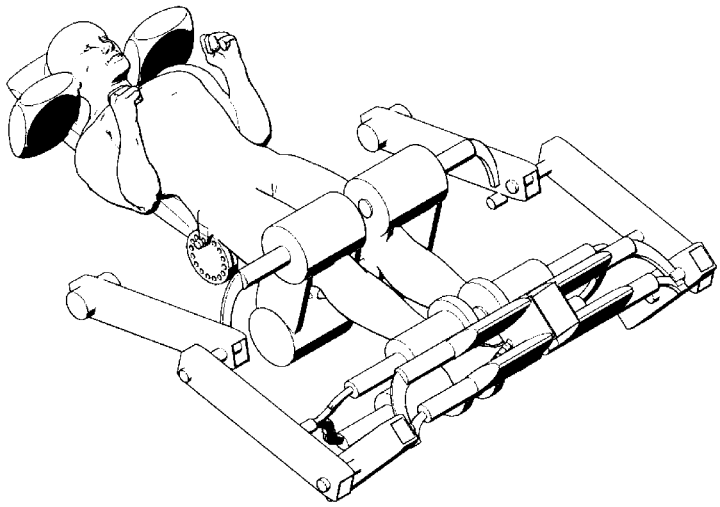

FIG. 34A is a perspective view of a start or finish position of a lower extremity and core exercise apparatus according to an embodiment.

Figure 34B:
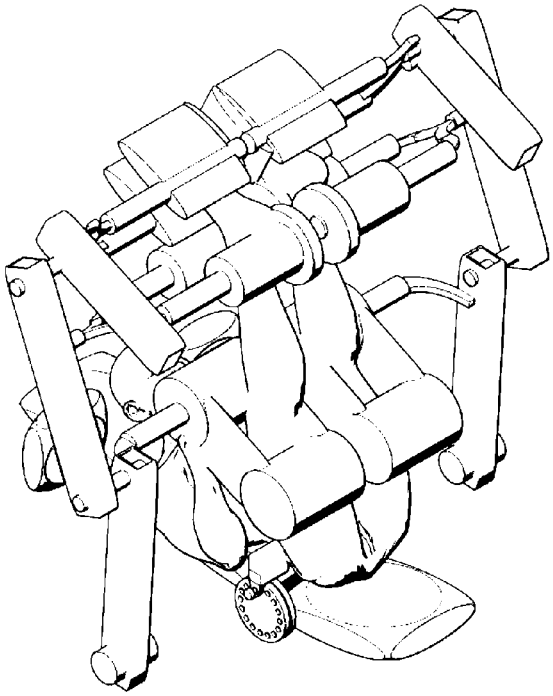

FIG. 34B is a perspective view of a start or finish position of a lower extremity and core exercise apparatus according to an embodiment.

Figure 35A:
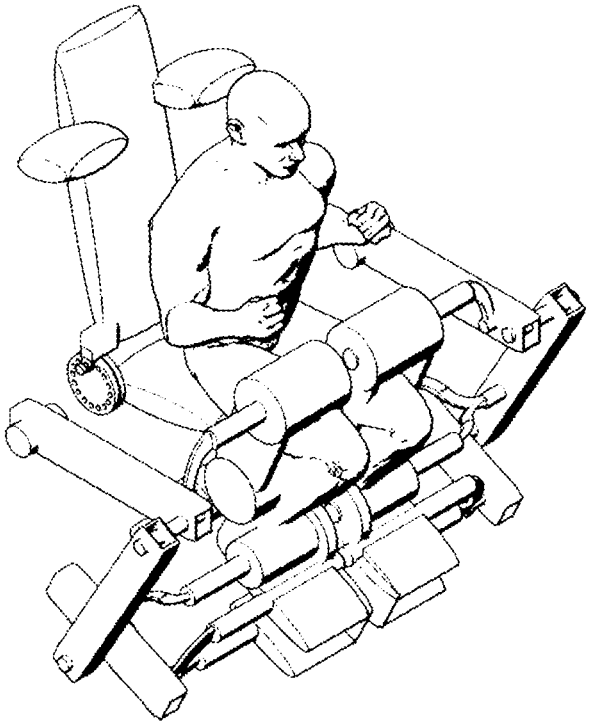

FIG. 35A is a perspective view of a start or finish position of a lower extremity and core exercise apparatus according to an embodiment.

Figure 35B:
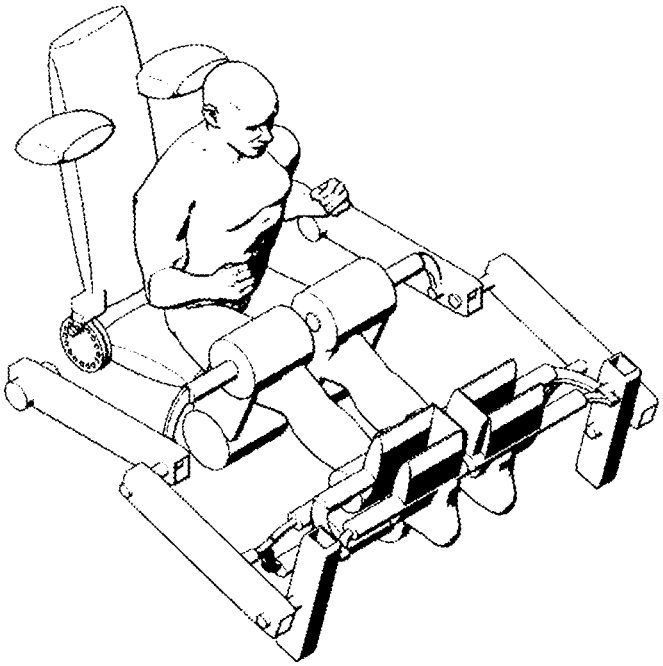

FIG. 35B is a perspective view of a start or finish position of a lower extremity and core exercise apparatus according to an embodiment.

Figure 36A:
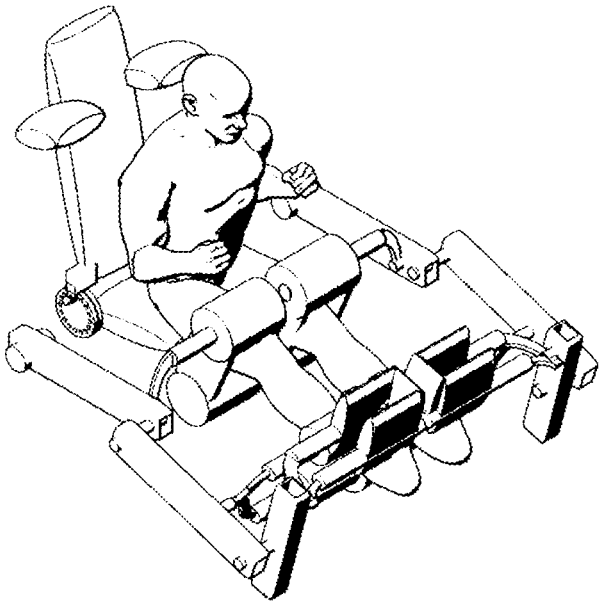

FIG. 36A is a perspective view of a start or finish position of a lower extremity and core exercise apparatus according to an embodiment.

Figure 36B:
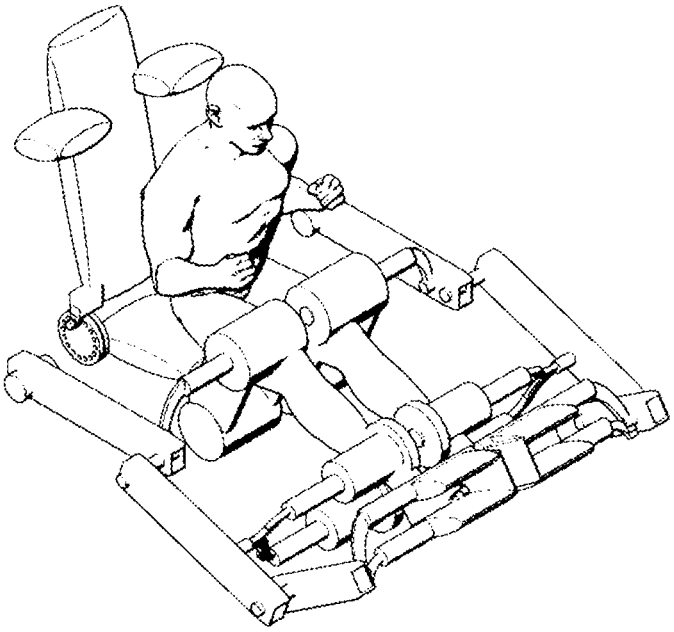

FIG. 36B is a perspective view of a start or finish position of a lower extremity and core exercise apparatus according to an embodiment.

Figure 37A:
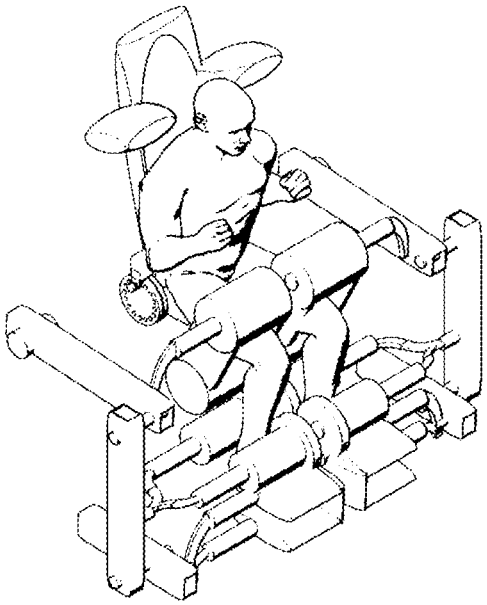

FIG. 37A is a perspective view of a start or finish position of a lower extremity and core exercise apparatus according to an embodiment.

Figure 37B:
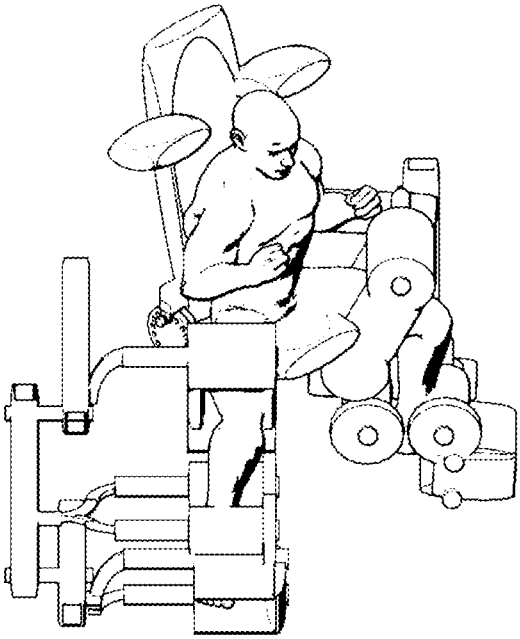

FIG. 37B is a perspective view of a start or finish position of a lower extremity and core exercise apparatus according to an embodiment.

Figure 38:
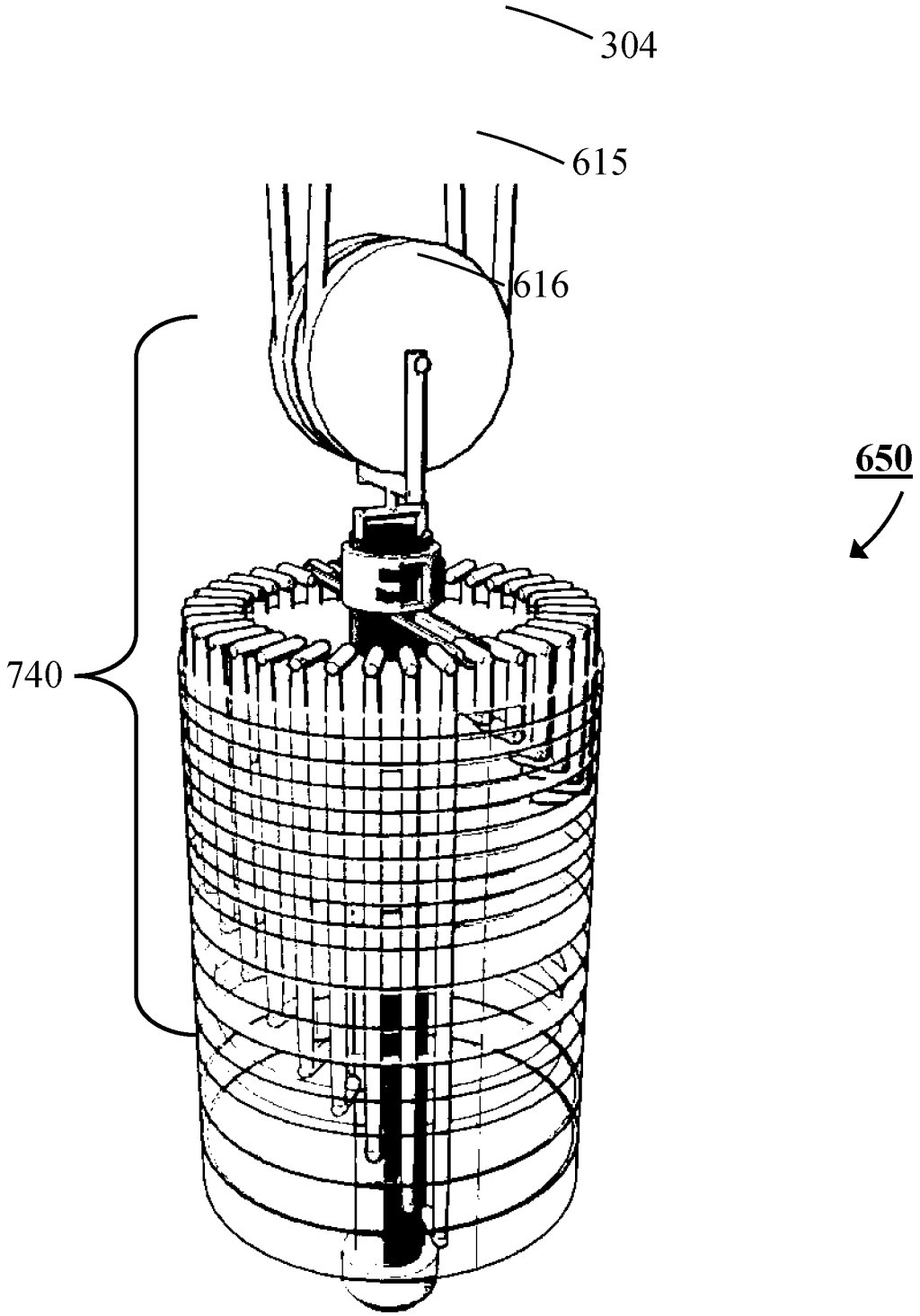

FIG. 38 is a perspective view of a weight stack and weight plates according to an embodiment.

Figure 39:
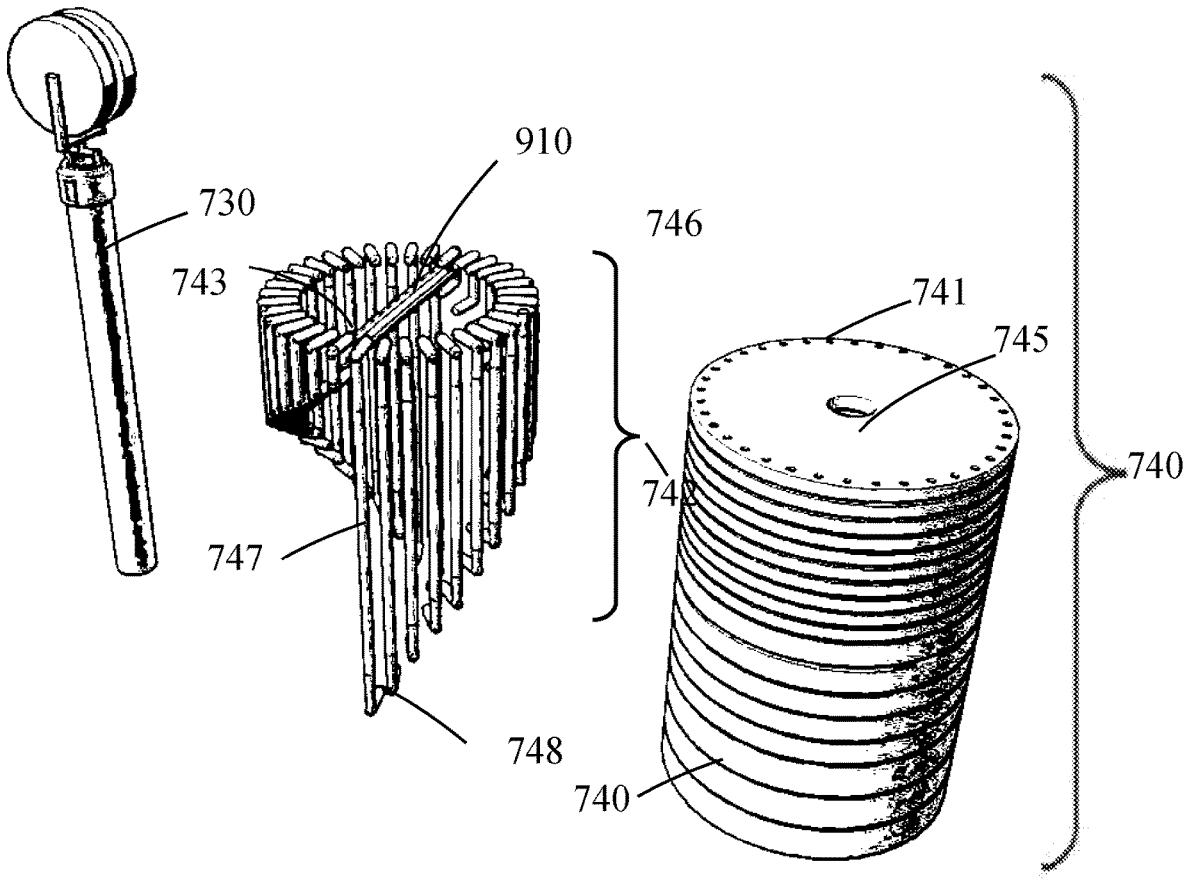

FIG. 39 is a diagram of separate components of a weight stack according to an embodiment.

Figure 40:
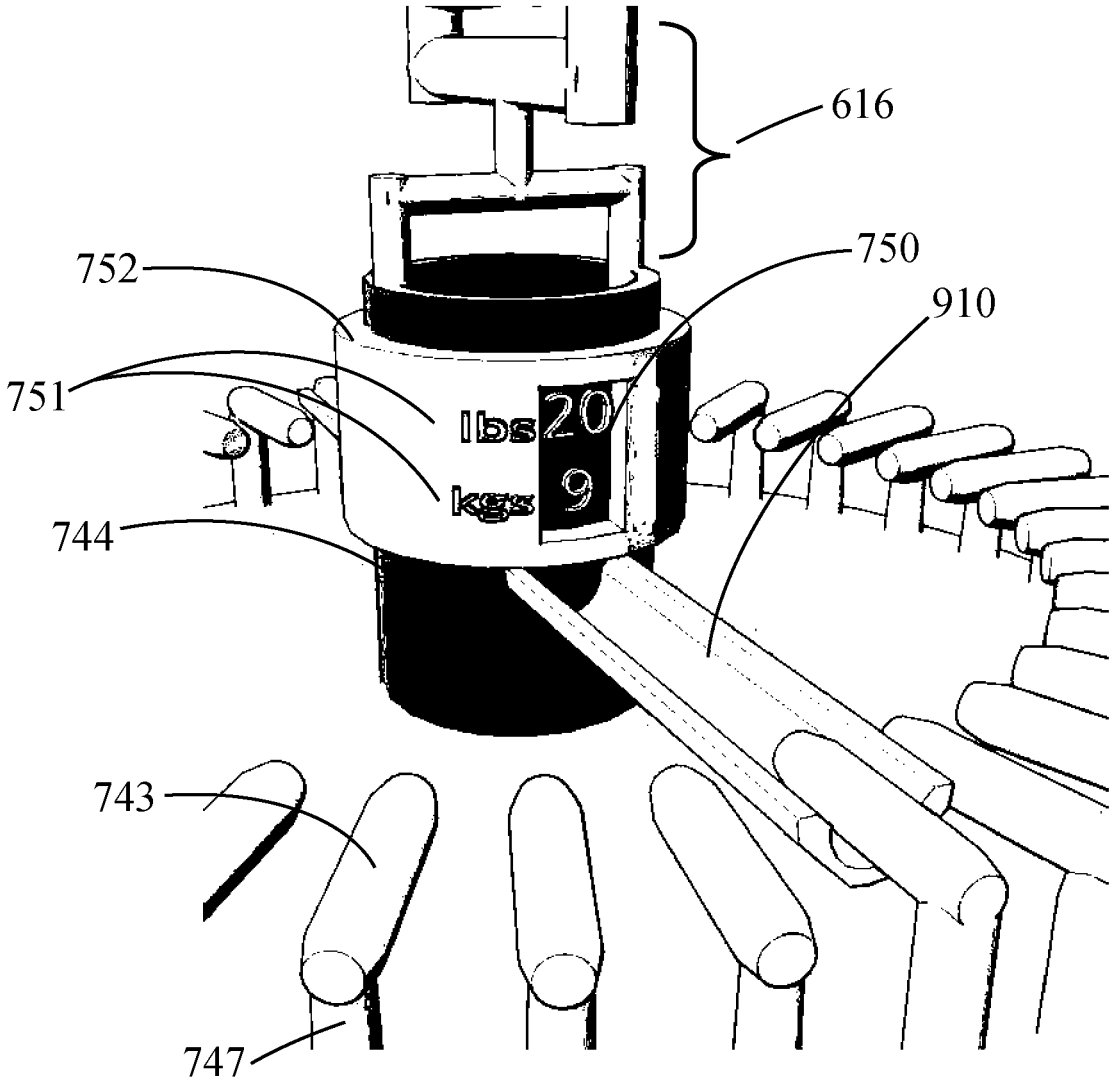

FIG. 40 is a perspective view of a weight carriage mechanism of a weight stack according to an embodiment.

Figure 41A:
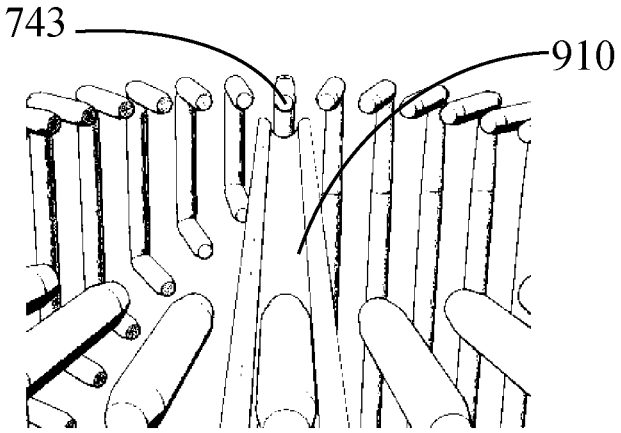

FIGS. 41A, B and C depict a weight carriage mechanism at various positions according to an embodiment.

DETAILED DESCRIPTIONS OF THE DRAWINGS

Before undertaking the detailed description below, it may be advantageous to set forth definitions of certain words and phrases used in connection to the disclosed exemplary embodiments: the terms "include" and "comprise," as well as derivatives thereof, mean inclusion without limitation; the term "or" is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

Although the subject matter of this application has been described with reference to illustrative embodiments, this description is not intended to be construed in a limiting sense. Various modifications and combinations of the illustrative embodiments as well as other embodiments will be apparent to persons skilled in the art upon reference to the description. It is, therefore, intended that the appended claims encompass any such modifications or embodiments. The general processes and systems described herein may be modified heavily depending on several factors, with rearrangement and/or addition/deletion of steps anticipated by the scope of the present disclosure. Integration of this and other preferred exemplary embodiment methods in conjunction with a variety of preferred exemplary embodiment systems described herein is anticipated by the overall scope of the presently disclosed system.

In the following detailed description, reference is made to accompanying drawings, and specific embodiments in which the invention may be used are shown by way of illustration. It is to be understood, however, that other embodiments may be utilized and that various changes may be made without departing from the spirit and scope of the present invention. The following description is, therefore, not to be taken in a limiting sense.

The presently described exercise apparatus is effectively discussed and described in two parts. First, embodiments of an upper extremity exercise apparatus, at times referred to as "Gunner" are described. It exercises the upper arms through the lever motion of the elbow joint, and the forearms though the ball and socket-like action of the wrist joint.

Next, a lower extremity machine, referred to at times as "Centaur," exercises the thighs through the lever motion of the knee joint is described. As with Gunnar, while the calves operate though a ball and socket-like action of the ankle joint, most strength is distributed through flexion and extension of the foot. For this reason, the lower extremity apparatus focuses on providing these actions. Similarly, due to the restricted motion of the hip joint due to a larger coverage of the acetabulum versus the glenoid, most strength is distributed through flexion and extension of the hip. For this reason, the lower extremity exerciser provides these actions but adds abduction and adduction of the hip. Additionally, Centaur provides flexion and extension of the core muscle group, viz. the abdominal wall and lower back muscles.

Upper Extremity Exercise Apparatus ("Gunner")

FIGS. 1-4 depict various views of an embodiment of upper extremity exercise apparatus 100. Note the user of upper extremity exercise apparatus 100 sits in one position for all exercises. In an embodiment, the user faces an accompanying video display screen 102. Video display screen 102 is connected electronically to upper extremity exercise apparatus 100. Through display screen 102 the user is able to view a variety of displayed information such as repetitions, weight, exercise type, resting period, vital signs, scenery traveled through, game interface, virtual instructor, television programs, movies, streaming entertainment, exercise dynamics (weights, repetitions, rest time, total exercise time, vitals), training, interactive games, and team competitions.

Figure 1:
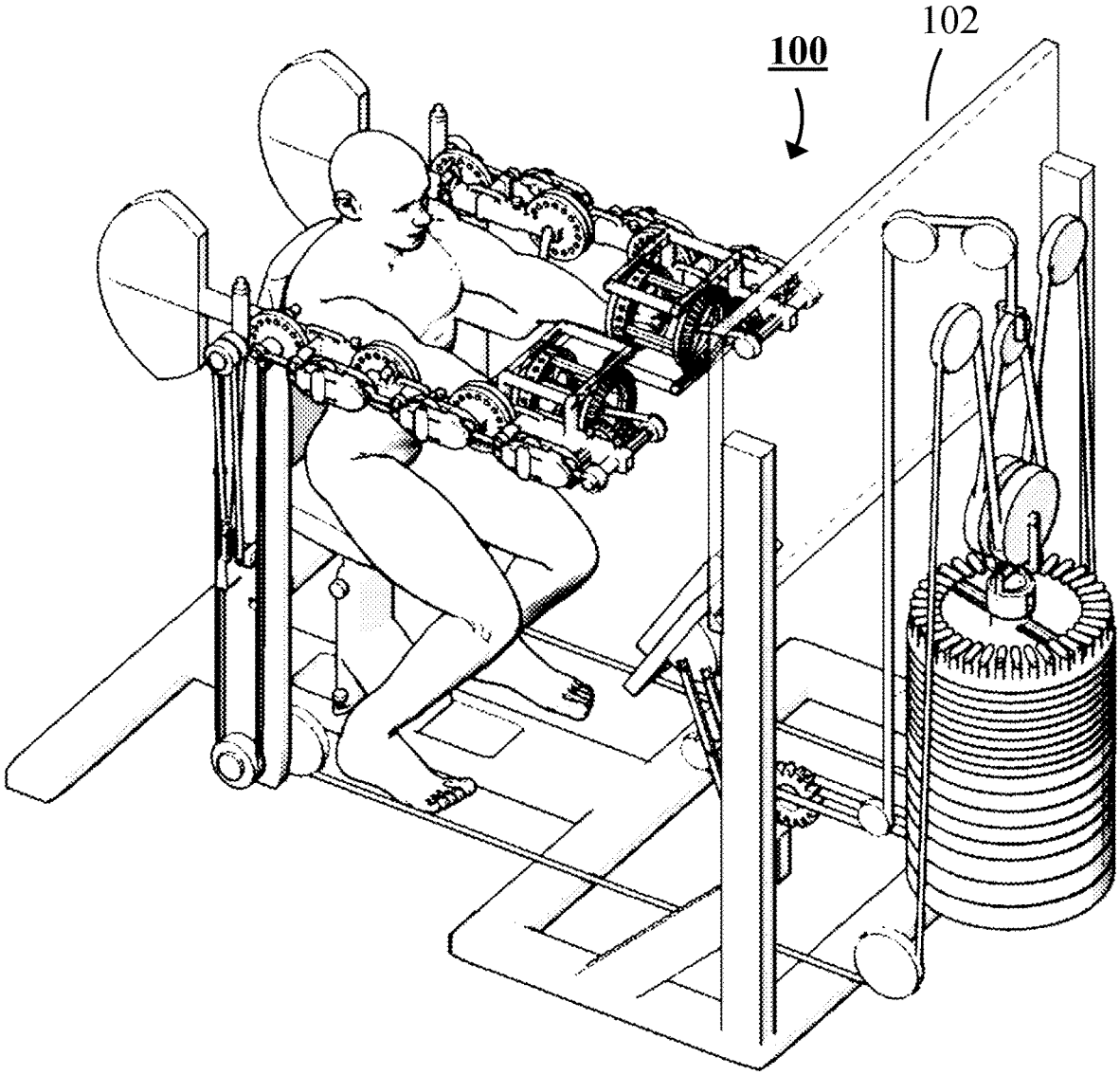
FIG. 1 depicts a perspective view of an upper extremity exercise apparatus according to an embodiment.
Figure 2:
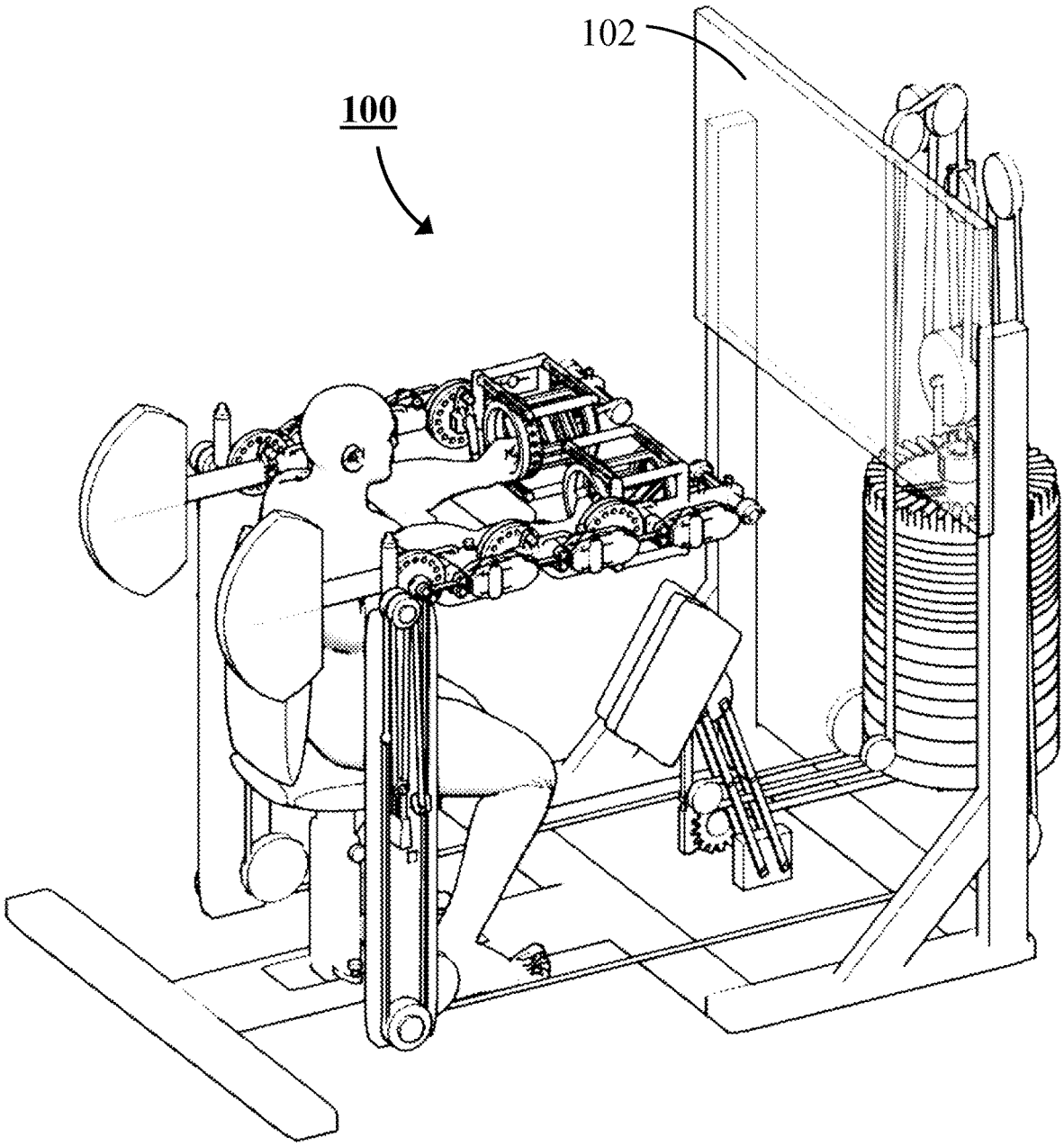
FIG. 2 depicts a perspective view of an upper extremity exercise apparatus according to an embodiment.
Figure 3:
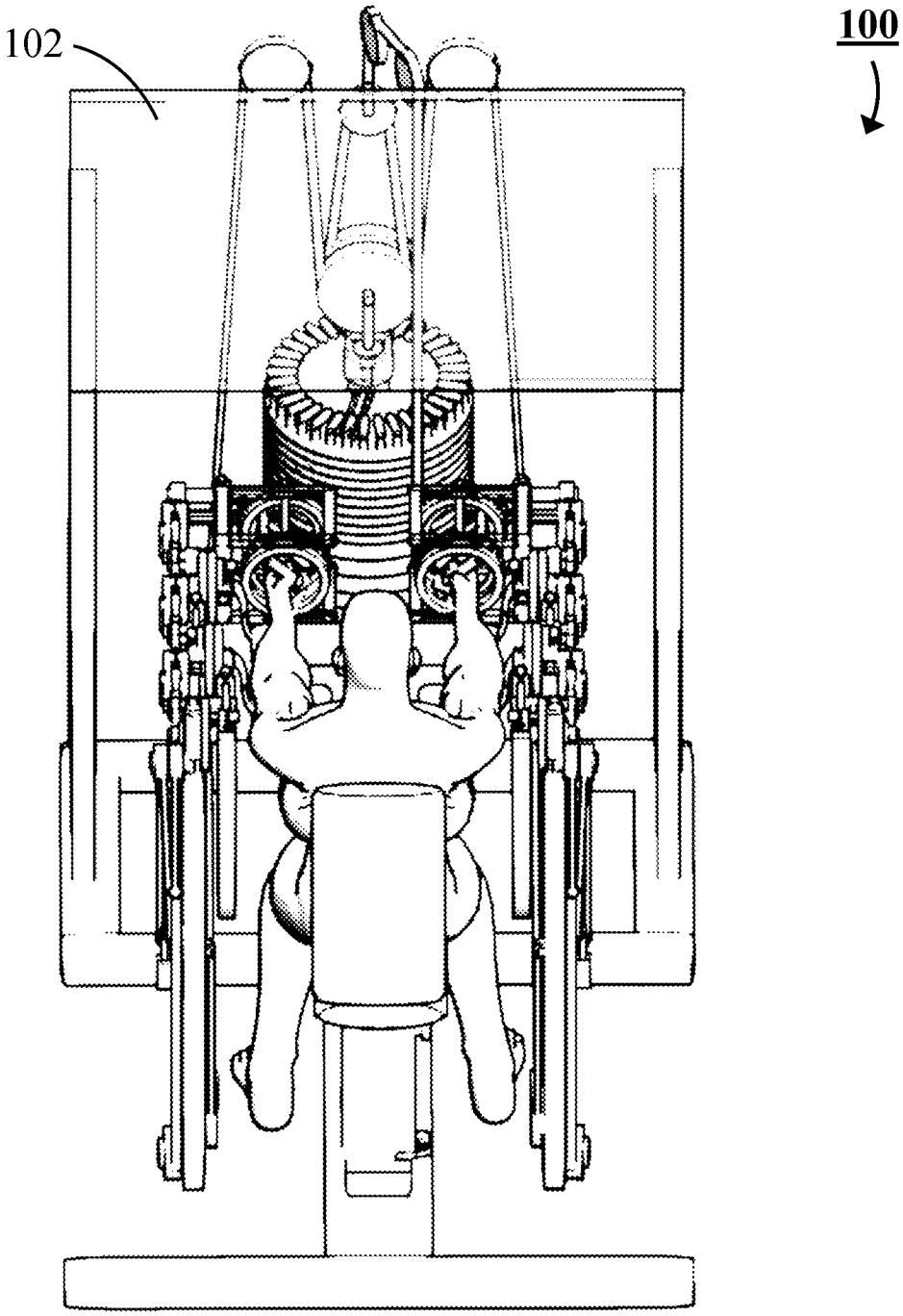
FIG. 3 depicts a perspective view of an upper extremity exercise apparatus according to an embodiment.
Figure 4:
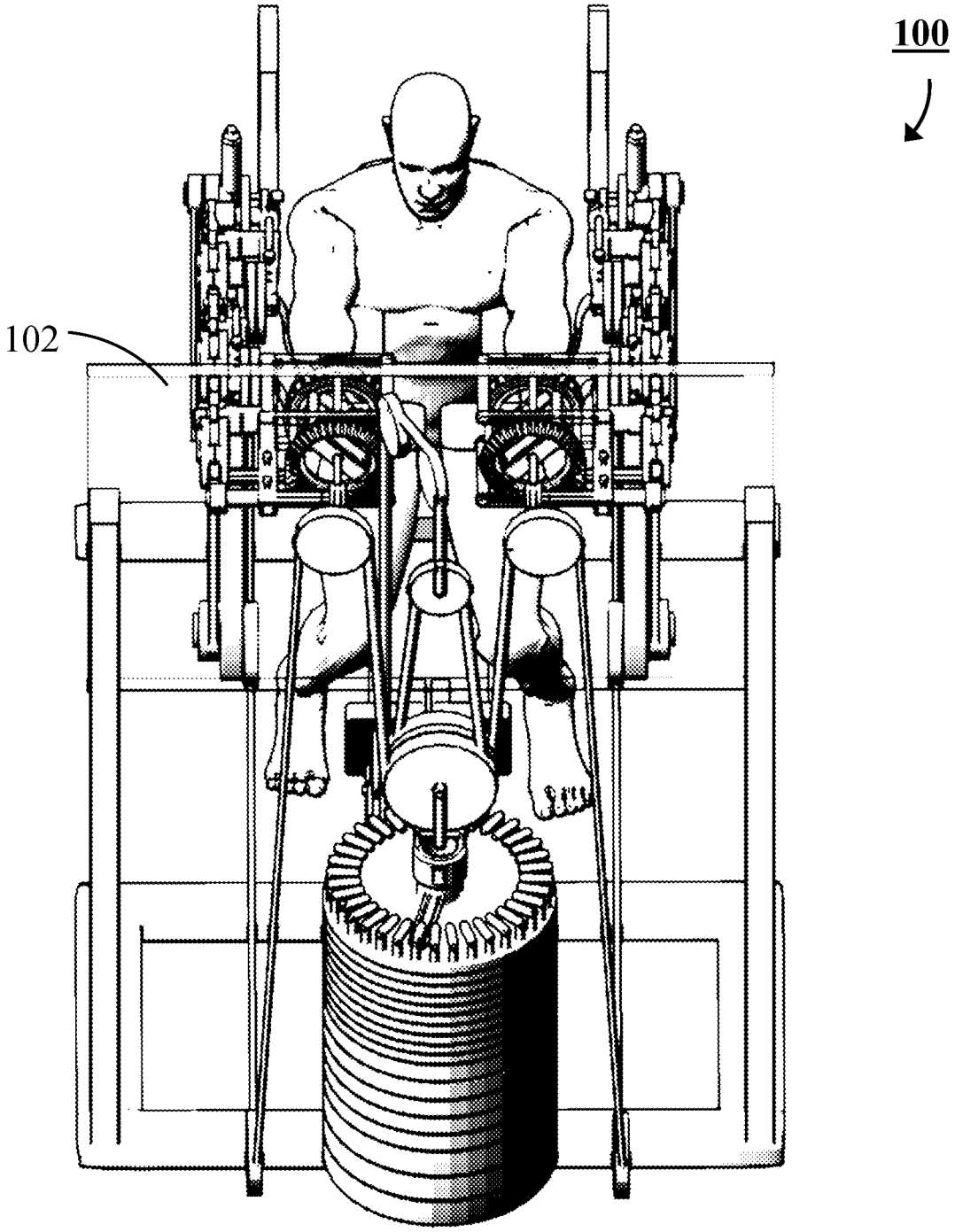
FIG. 4 depicts a perspective view of an upper extremity exercise apparatus according to an embodiment.
Figure 5:
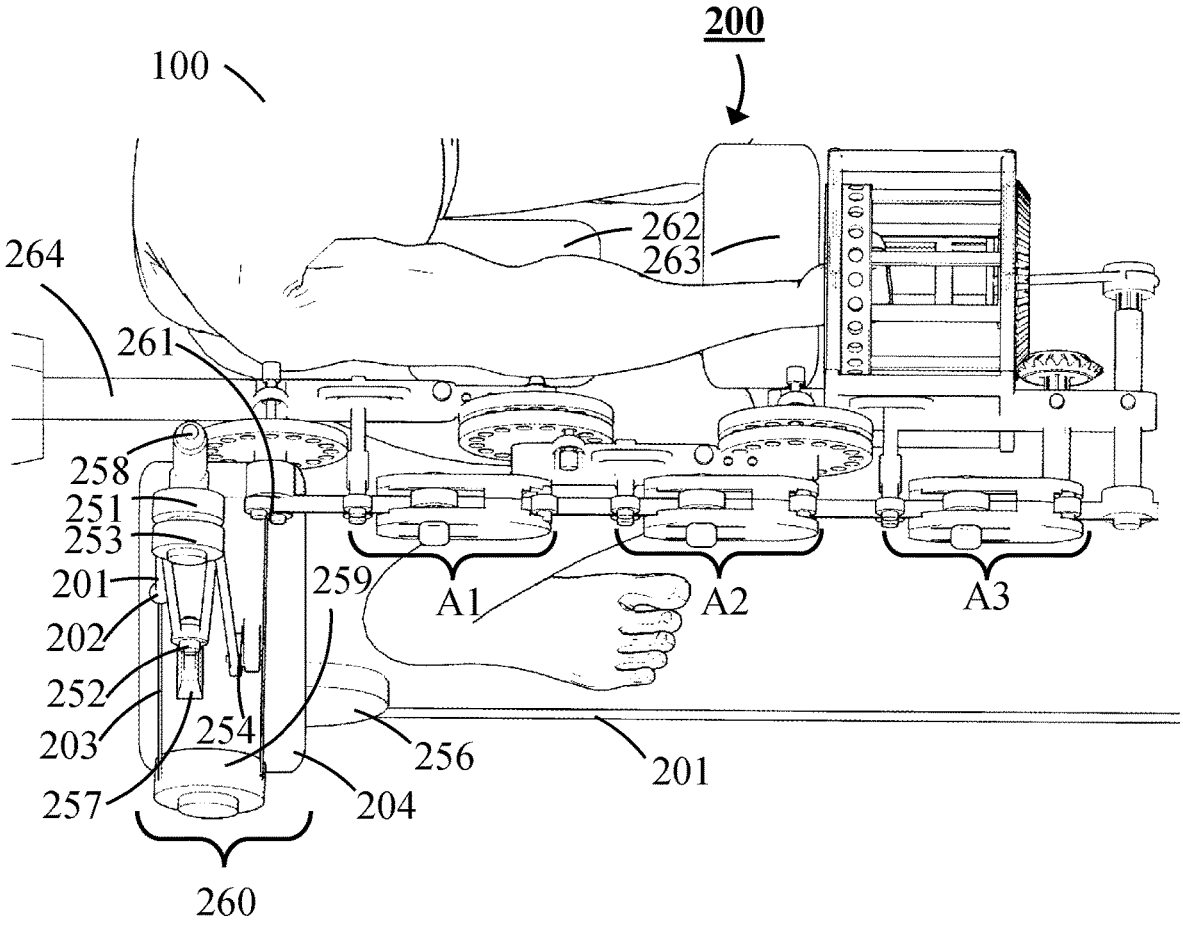
FIG. 5 is a top view of a proximal portion of an upper extremity exercise apparatus according to an embodiment.

FIG. 5 is top view of the proximal portion 200 of the right side upper extremity apparatus 100 as operated by the user. The left side is identical but reversed. The distal apparatus will be described later.

In FIG. 5, cable converter 260 converts a flat cable associated with proximal unit 200 to a rounded cable associated with a distal unit. Cable converter 260 takes up slack in the flat cable depending on the adjusted length of proximal armature (first armature) 264, depending on the individual user's limb dimensions. Working forward to the weight stack, ball joint 202 connects flat cable 203 to round cable 201 which wraps around first proximal pulley 251, second proximal pulley 252, third proximal pulley 253, fourth proximal pulley 254, and fifth proximal pulley 255 (obscured), then over sixth proximal pulley 256 to extend toward the weight stack described later. Proximal weight 257 pulls down on the cable when slack. Button 258 locks the position of second proximate pulley 252, which is movable.

Starting again from ball joint 202 and working back towards the proximal unit, flat cable 203 traverses proximal bottom pulley 259 then first double pulley 261. This is shown in higher detail in FIG. 6. Flat cable 203 travels through similar cable pull units A1, A2, and A3 with A1 shown as first cable pull unit 280 in detail in FIG. 7. In use, the user rests his elbow and wrist on elbow pad 262 and wrist pad 263, respectively. Elbow pad 262 and wrist pad 263 are disposed forward of the user in FIG. 5, on wrist rotation and gripping apparatus, described in detail in FIG. 12.

Figure 6:
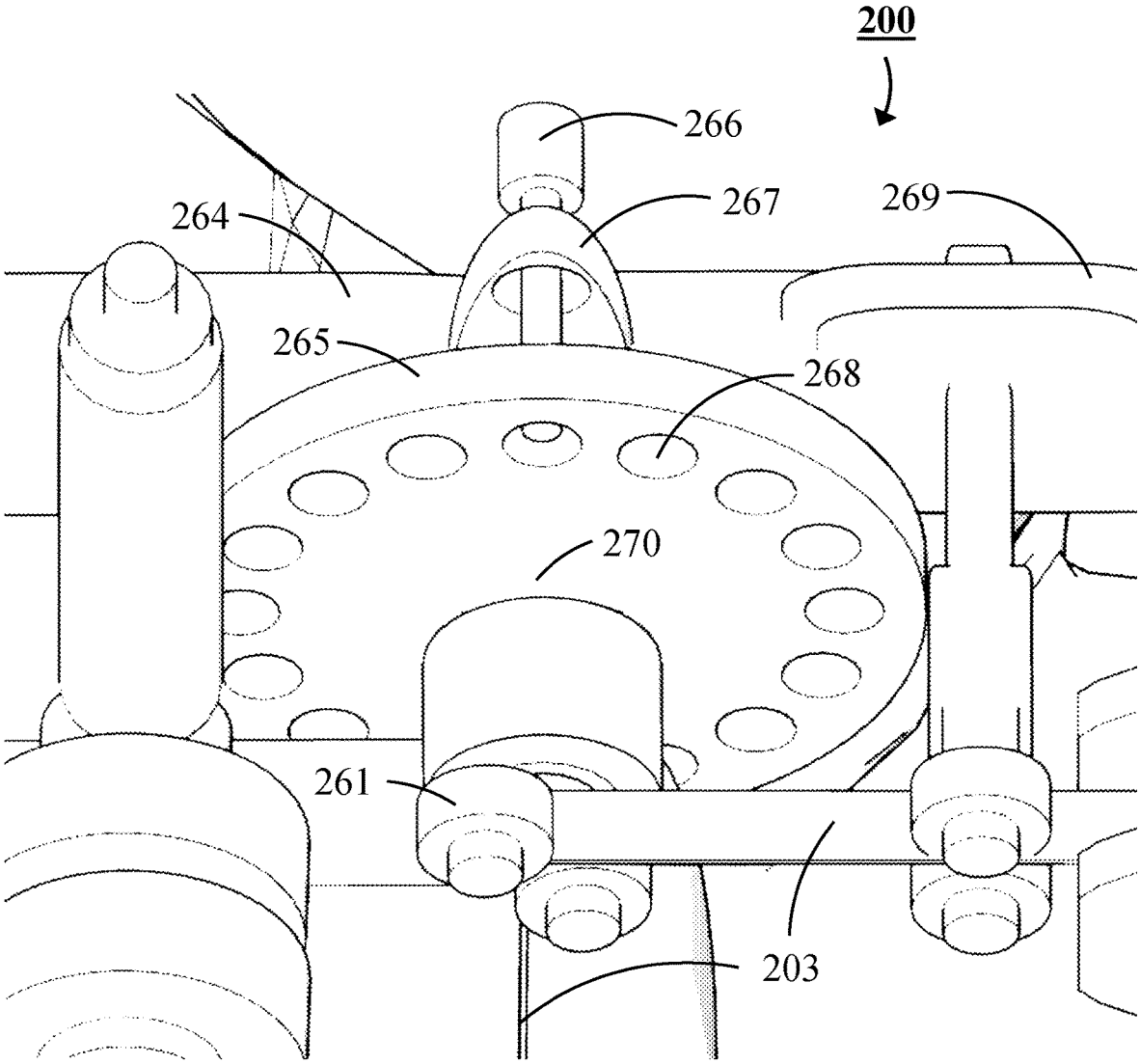
FIG. 6 is a perspective view of a proximal portion of an upper extremity exercise apparatus according to an embodiment.

FIG. 6 is a detailed view of proximal portion 200 of upper extremity exercise apparatus 100. Again, the right sided apparatus is shown. In FIG. 6, flat cable 203 traverses first double pulley 261 toward the A1, A2, and A3 units (see FIG. 5). Armature 264 pivots on an axis that traverses an imaginary line through the user's shoulders. Lifting on handle 269 rotates armature 264 about proximal main axle 270. The angle of proximal armature 264 is locked into place with pin first 266 through first pin guide 267 into various positioning holes 268 in first perforated disk 265.

Figure 7:
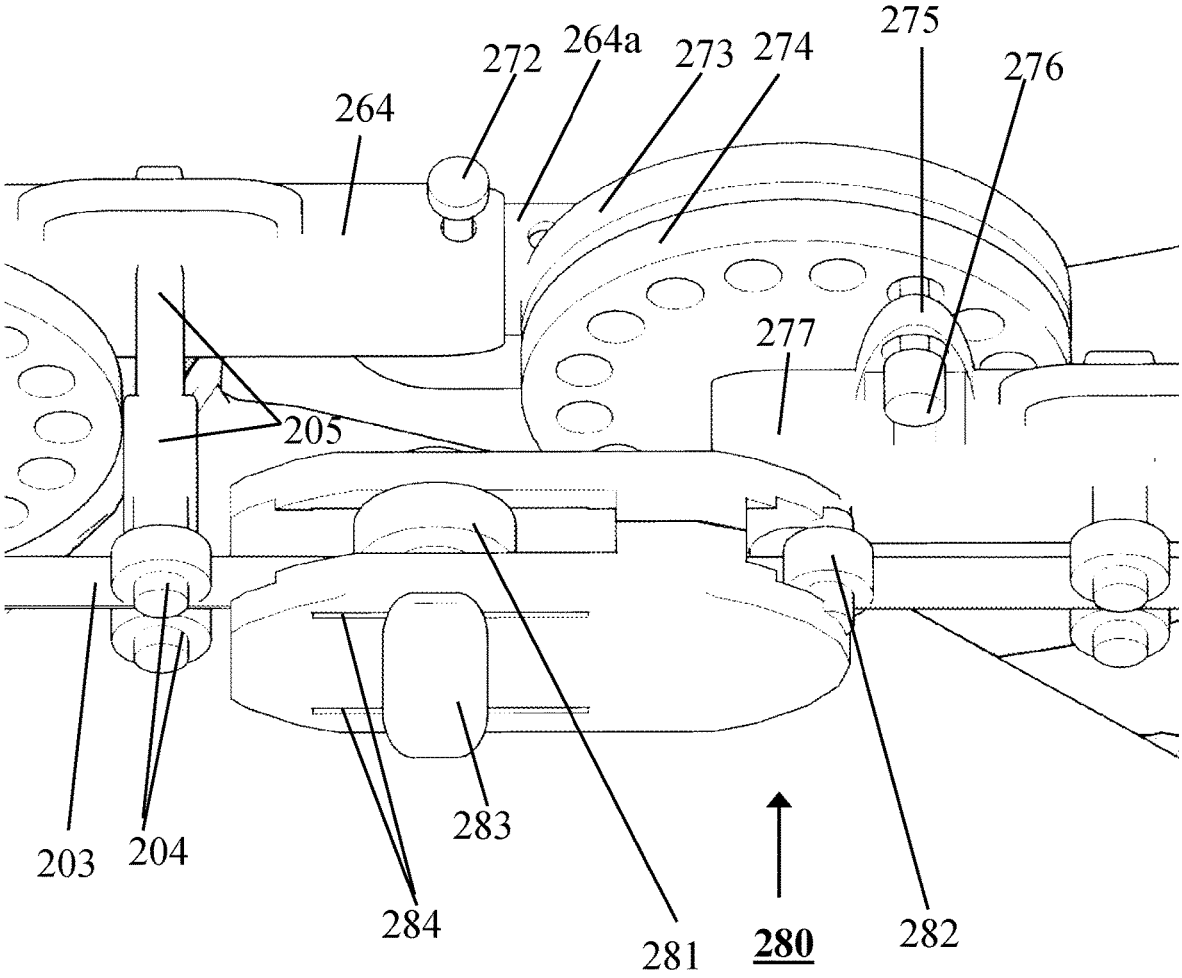
FIG. 7 is a perspective view of a cable pull unit of an upper extremity exercise apparatus according to an embodiment.
Figure 8A:
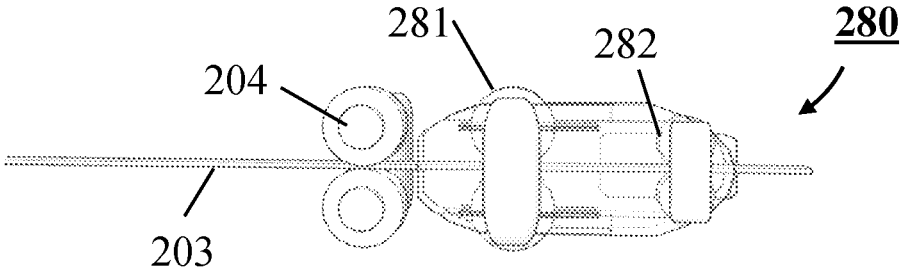
FIGS. 8A, 8B, 8C and 8D are top views of various points of operation of a cable pull unit of an upper extremity exercise apparatus according to an embodiment.
Figure 8B:
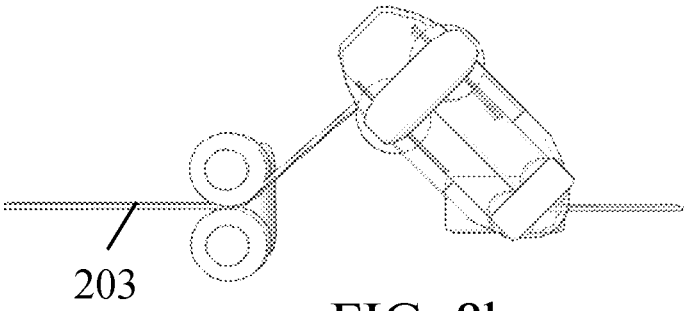
Figure 8C:
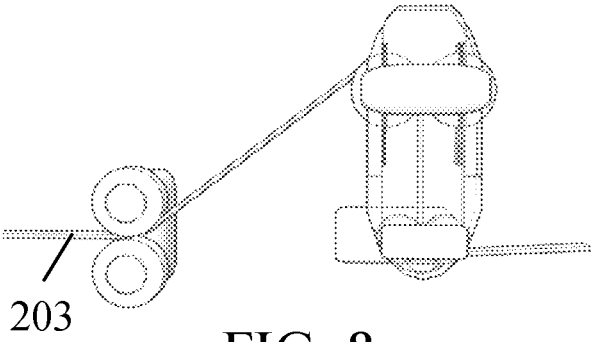
Figure 8D:
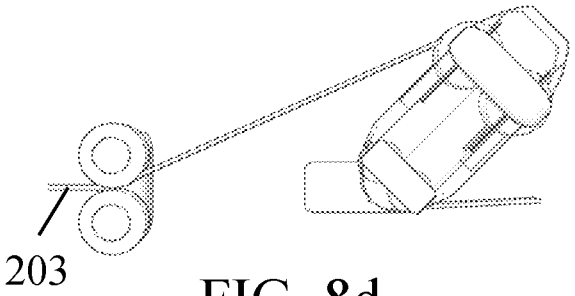

FIG. 7 is a diagram showing detail of first cable pull unit 280, shown as "A1" in FIG. 5. As flat cable 203 enters from the left, it traverses second double pulley 204, supported by bar 205 integrated with armature 264. Sliding inside and extending into proximal armature 264 is proximal extension armature 264*a* perforated with selection holes (obscured) selected by second pin 272. First selection disk 274 and second selection disk 273 are each selected by third pin 276 through pin guide 275. Insertion of the pin only deep enough to traverse first selection disk 274 sets the rotation angle starting point of center armature 277 with respect to armature 264. In this position center armature (second armature) 277 with respect to armature (first armature) 264 and proximal armature 264 rotate with resistance provided by first cable pull unit 280. If pin 276 is further inserted into second selection disk 273, the angle of center armature 277 with respect to proximal armature 264 is fixed.

Once flat cable 203 passes through second double pulley 204, it enters first cable pull unit 280, of which the Gunner unit contains six total. Flat cable 203 passes through third double pulley 281 then through fourth double pulley 282. Third double pulley 281 fixes to proximal handle 283 allowing adjustment of the horizontal position of third double pulley 281 along guides 284. The change in torque as a function of angle and horizonal position of third double pulley 281 is described later. The structure and function of the A2 and A3 of FIG. 5 cable pull units is similar. The second double pulley 204, third double pulley 281, and fourth double pulley 282 make up a pulley assembly of the cable pull unit.

FIGS. 8*a-d* are detailed diagrams showing the mechanism of the cable pull unit 280 (shown transparent for illustrative purposes) through progressive rotation. This is the fundamental mechanism of raising the weight stack. When the user causes rotation of cable pull unit 280, it pulls on flat cable 203. The force is intentionally not linear with angle of rotation initially allowing a lower resistance, then higher, then lower. Second double pulley 204, third double pulley 281, and fourth double pulley 282 rotate allowing three cable pull units 280 (A1, A2 and A3 in FIG. 5), to simultaneously pull on flat cable 203, enabling compound exercises. In another embodiment, the system could be simplified with third double pulley 281 and fourth double pulley 282 not rotating if compound exercise is not desired.

Figure 9:
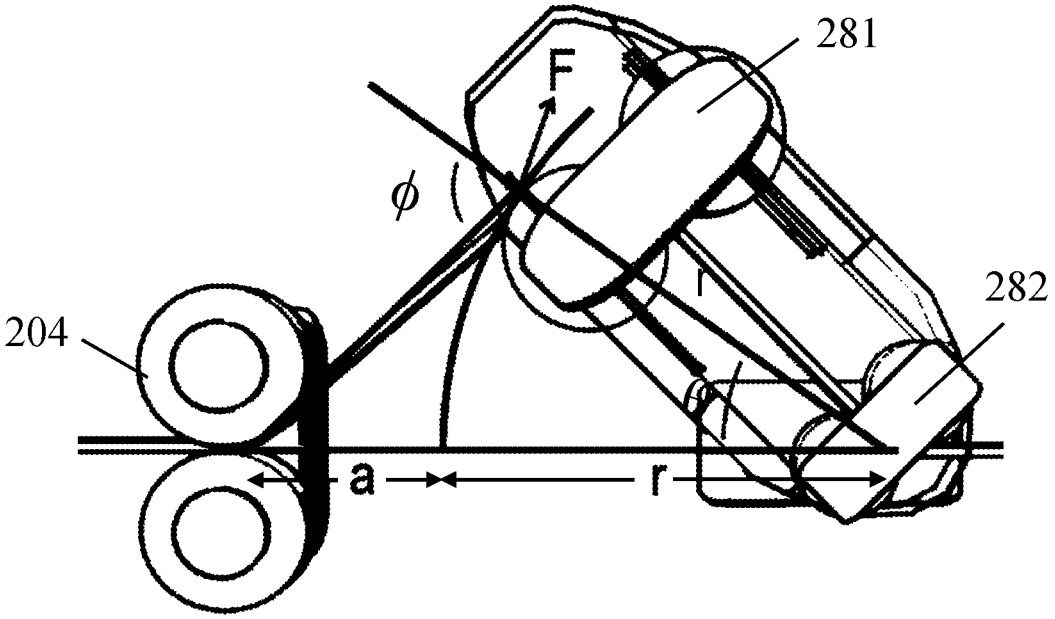
FIG. 9 is a top view of operation of a cable pull unit of an upper extremity exercise apparatus according to an embodiment.

FIG. 9 is a schematic diagram, assuming the wheels are point sized to simplify the geometry, showing the various geometric dependencies. Assuming the distance from the center of fourth double pulley 282 to the leftmost point of third double pulley 281 is "r" and the distance from third double pulley 281 to the second double pulley 204 is "a", sin ($\phi$) is proportional to the force or resistance as a function of angle "θ" as given in the equation:

$$\sin(\phi) = \sin\left(\theta + \sin^{-1}\left(\frac{r \cdot \sin(\theta)}{\sqrt{r^2 + (a+r)^2 - 2r(a+r)\cos(\theta)}}\right)\right)$$

FIG. 10*a* and FIG. 10*b* depict two extreme positions of third double pulley 281. In FIG. 10*a*, the overall resistance of third double pulley 281 is higher and peaks early, where a1 and a2 are the distances referred to in FIG. 9. In FIG. 10*b*, the overall resistance of third double pulley 281 is lower and peaks later, where a2 and r2 are the distances referred to in FIG. 9.

FIG. 11 is a graph that shows the net resistance (torque/force) for the left position (solid line) with r1=2 and a1=1, and right position (dotted line) with r2=1 and a2=2.

FIG. 12*a* is a perspective view of a wrist exerciser 250 of upper extremity exercise apparatus 100. There are three main exercises performed by use of wrist exerciser 250. Flexion/extension/lateral/medial excursion of the wrist, internal/external rotation of the wrist, and gripping exercise. Wrist exerciser 250 is associated with the third cable pull unit, A3 shown in FIG. 5. For illustrative purposes, the components associated with the third cable pull unit associated are labelled similarly to the components in FIG. 7 and do not bear repeating here.

Flexion/Extension/Lateral/Medial Excursion of the Wrist

Continuing with FIG. 12*a*, in operation of wrist exerciser 250, the user grips first handle 218 that can be positioned in any of 360 degrees through attachment to sliding ring 282 fixed into position within perforated handle ring 283 selected by a button sticking out of the end of 218 (obscured on the figures). Inner ring 282 and perforated handle ring 283 are secured to bracket 284 shown transparently for illustrative purposes. Bracket 284 contains an inner slider 285 allowing wrist exerciser 250 to slide to the right or left in relation to the user positioning hands closer together or further apart. When the user flexes or extends the wrist, center armature 279 is rotated with respect to proximal extension armature 277*a* (when disk selection pin 276 inserts only as far as selection disk 274) rotating cable pull unit 280 causing tension on flat cable 203.

Internal/External Rotation of the Wrist

Continuing with FIG. 12*a*, the user can rotate the wrist internally or externally. Perforated handle ring 283 connects to first beveled gear 286 by struts 287. Rotation of first beveled gear 286 rotates second beveled gear 288, rotating first axle 289. This in turn rotates cable pull unit 280, causing tension on the flat cable 203. Pin 298 locks the rotation of wrist exerciser 250 in place when wrist rotation is not desired.

Gripping Exercise

FIG. 12*b* is depicts operation of the gripping exercise with the user grasping a second handle 219. While holding first handle 218, the user may extend the fingers to grasp the grip second handle 219, 12*b*. Second grip handle 219 is disposed farther from the user than first grip handle 218.

Second grip handle 219, attaches to two struts 291 (one obscured) that attach to outerbar 292. Outer bar 292 is attached to cord 293 that wraps around disk 294 that rotates second axle 295 and first rotating disk 296 causing tension on flat cable 203. Pin 297 locks in the gripping mechanism.

FIG. 13 depicts how armature 264 operates for biceps exercise in a preacher curl type position. The left image shows the starting point, and the right image shows the end point of the exercise. In each diagram, the elbow joint aligns with the rotating axis (arrow) of rotating cable pull unit 280. A review of the rotating mechanism of cable pull unit 280 is shown in FIGS. 8*a*-8*d*. As the user flexes the biceps, cable pull unit 280 pulls on the flat cable elevating the associated weight stack. The user may hold the first handle 218 or second handle 219 in a variety of rotation positions. Holding the handgrip in the prone position would focus exercise on the brachioradialis muscles. Similarly, in this position, the user could start the exercise in the right hand position and finish in the left hand position working the triceps muscles.

FIG. 14 depicts how armature 264 operates for triceps exercise in a behind the head type position. The mechanics are almost identical to the biceps exercise except armature 264 has rotated to a vertical position and the middle armature begins at a 90 degree angle to armature 264. The left image shows the starting point, and the right image shows the end point of the exercise. In each diagram, the elbow joint aligns with the rotating axis (arrow) of cable pull unit 280 within A1 (FIG. 5). As the user flexes the triceps, armature 280 pulls on flat cable 203 elevating the weight stack.

FIG. 15 is a diagram demonstrating exercise of the anterior forearm mobilizing cable pull unit 280 within A2 (FIG. 5). The left image shows the starting point, and the right image shows the end point of the exercise. In each diagram, the wrist joint aligns with the rotating axis (arrow) of rotating cable pull unit 280. As the user flexes the wrist, cable pull unit 280 pulls on the flat cable 203 elevating the weight stack. Similarly, the posterior forearm may be exercised by starting the unit in the opposite position.

FIG. 16 is a diagram demonstrating the function of the A3 unit. The user has the option to start and end the wrist rotation from any position. Here the user grips first grip handle 218 in a beginning position on the left in an anterior position and pronates to a posterior position. As the user twists first grip handle 218, this rotates cable pull unit 280 within A3 (FIG. 5) about the axis indicated by the arrow causing tension on flat cable 203. The right sided position could serve as the starting position with the left side the finish position.

FIG. 17 is a diagram demonstrating the start (left) and finish (right) of the gripping mechanism. As the user pulls second handle grip 219 toward first grip handle 218, this causes tension on cord 293 that wraps around disk 294 causing disk 294 to rotate. This rotates second axle 295 and first rotating disk 296 causing tension on flat cable 203.

FIG. 18 depicts bilateral, posterior elements of the apparatus. Round cable 201 penetrates first vertical armature 204, traverses pulley first vertical armature pulley 255, extends down to first lower disk 256 then forward to the weight stack assembly. Base and seat assembly 300 comprises stabilizing beams 301, 302, 303, 304, and 305. 306 and 307 to provide support for the video screen more superiorly (not shown). Indentation in 308 allows seat assembly to move forward and backward. Main seat support 314 fits into 308 groove with anterior support 311. The position of main seat support 314 is fixed by first selection pin 309 through pin guide 310. The seat is adjusted up and down within extension 313 with second selection pin 312.

FIG. 19 is a diagram of pedal system 400 according to an embodiment of the present upper extremity exercise apparatus ("Gunner") with focus upon the elements of left pedal weight selector 401 system that controls the weight plate selection. The specific embodiments and details of the weight stack assembly are provided in a co-pending U.S. patent application Ser. No. 17/825,991 filed May 26, 2022, naming the same inventor as the present application, which is incorporated herein by reference. When pedal weight selector 401 is pressed at the top or bottom, it raises or lowers the number of weight plates selected, respectively. By example, pressing the top of left pedal weight selector 401 rotates gear 403 which in turn lowers rack 404 connected to beam 405, then lowering rack 408, causing the turning of gear 406 counterclockwise pulling on the lower of pedal cables 409. This causes rotation of gears under the weight stack to rotate the selection rod. Note left pedal weight selector 401 has a left medial ridge 490 and right pedal 402 has a right medial ridge 491 to keep the user from catching their foot under the opposing pedal.

FIG. 20 depicts pedal system 400 of the Gunner apparatus focusing on the elements of right pedal system 402 that assists in raising the weights. When right pedal 402 is pushed anteriorly right pedal base 411 also moves anteriorly angling struts 413 posteriorly rotating about upper support rods 412 superiorly and lower support rods 416 inferiorly. Lower support rods 416 imbed into base block 415. As struts 413 angle anteriorly, they pull on cable 410 attached to cable rod 417 (with middle rod 418 providing additional stability). Cable 410 traverse fixed pulley 414, continues anteriorly to remote pulley 420, then ascends to the assist pulleys Alternate Wrist and Gripper Mechanism for Gunner Depending on the ease and expense of construction, an alternate method of taking up the slack in the flat cable mechanism may be desired. Also, an alternate method embodiment of the wrist and gripper mechanism along a single rather than double axle may be more convenient and usable.

FIG. 21A and FIG. 21B depict an alternate embodiment of the wrist and gripper mechanism allowing the two axles 289 and 295 to be concentric as one in FIG. 21*a* and FIG. 21*b*. FIG. 21*c* depicts the contrasting construction of the previous embodiments. FIG. 21*b* depicts slider 510 allowing selection of the wrist exercise, gripper exercise, or neither. Also, an alternate method of taking up the slack in the flat cable is shown in cable slack adjuster 500.

FIG. 22A and FIG. 22B show in detail the cable slack adjuster 500 in the unlocked and locked positions, respectively. The inset in each diagram shows a blow up of the detail. In the unlocked position of FIG. 22*a*, the user adjusts the lengths of each armature specific to his limb length allowing the cable to move freely allowing more or less cable length. Once the cable length is determined, the user locks the cable in place to perform the exercises.

As shown, flat cable 203 enters the cable slack adjuster 500 passing through squeeze plates 501 and 502, which in one embodiment are made of rubber, but other suitable material may be used. Note there is a gap between flat cable 203 and right squeeze plate 502 in the unlocked position. Flat cable 203 passes through squeeze plates 501 and 502 and is wound in coil 503, tethered centrally by spring 504. A spacer 505, made of metal or other suitable material, is placed on 203 as a stop point for maximum slack.

The distal detail of the locking rod 506 is shown in the insets of the figures. Outer casing 508 holds selection pin 507 that pivots on ball joint 509. Selection pin 507 inserts into the upper (unlocked) or lower (locked) position in pin holder 506. In the unlocked position, squeeze plates 501 and 502 are separated allowing free movement of flat cable 203 between them. When locking rod 506 is rotated to the locked position, short rack 511 and pinion 510 engage to move block 512 to the left, in turn moving squeeze plate 502 to the left, fixing flat cable 203 between squeeze plates 501 and 502.

FIGS. 23A and 23B show the proximal detail of the selector pins. FIG. 23*a* shows the rest position of locking rod 506 with the selector pin 507 extended to the left. When the user desires to move the position of selector pin 507, he depresses button 513 pushing shaft 514, spring retainer 515, and upper rack 522 to the left. This rotates pinion 520 about pinion axis 521 counterclockwise moving lower rack 519 to the right pulling selector pin 507 to the right. First spring 518 and second spring 516 keep button 513 and selector pin 507 in a neutral position, as shown in FIG. 23*b*.

FIG. 24 depicts a cross-sectional view of an alternate embodiment of the wrist and gripper assembly of an upper extremity exercise apparatus. Note the wrist and gripper mechanisms are now concentric, consisting of a variety of coaxial sleeves. The outer sleeve corresponding to the wrist mechanism, connects to the apparatus through the previously described beveled gear 288 from FIG. 12*a*, attached to fixed armature 279 by extender 901. The inner sleeve corresponding to the gripper mechanism, connects to the apparatus through the previously described disk 294 from FIG. 12*a*, attached to fixed armature, 289*a* with extender, 902. The sleeve selector determining which sleeve rotates is shown in the dotted area with detail shown in FIGS. 25*a-c*. The sleeves attach to the central core 905 with upper flanges 713 that attaches to the cable pulling unit, 280, previously described in FIG. 7. Roller bearing sleeves, 904, are positioned as shown with one inside armature 279 and one lateral to 279 within shaft 289. Slide selector 510 is shown in more detail in FIGS. 25*a-c*.

FIGS. 25A-C show blowup details of slide selector 710, shown as dotted line area of FIG. 24 for each of the three positions of slide selector 710. Slide selector 710 determines which sleeve is "selected" to turn. Slide selector 710 is held in place with spring 711. Slide selector 710 determines the position of ring 712 (shown as cross section). Ring 712 slides on post 715 with first tab 714. FIG. 25*a* shows the "null" position where neither the wrist nor the gripper mechanism are engaged as first tab 714 does not engage second tab 716 (of the 289 sleeve for the wrist mechanism) or third tab 717 (of the 289*a* sleeve for the gripper mechanism). FIG. 25*b* shows slide selector 710 moved one position to the right now engaging second tab 716 (of the wrist mechanism) with tab 714 rotating 715 which is attached to shaft 905 rotating flanges 713 attached to resistance unit 280. FIG. 25*c* shows slide selector moved two positions to the right now engaging Third tab 717 (of the gripper mechanism) with tab 714 rotating 715 which is attached to shaft 905 rotating flanges 713 attached to resistance unit 280.

FIGS. 26A and 26B show a simplified cable converter 260*a* according to an alternative embodiment, as compared to cable converter 260 of FIG. 5, for comparison, respectively. In FIG. 26*a*, the simplified construction, the slack adjuster system is removed as its function is performed by cable slack adjuster 500 at the other end of the unit near the wrist mechanism. Selector pin 258 of FIG. 26*b* is also no longer needed. Flat cable 203 now connects to round cable 201with ball connector 202. Round cable 201 loops around repositioned pulley 256.

Lower Extremity and Core Exercise Apparatus ("Centaur")

FIGS. 27-30 depict four views of an embodiment of a lower extremity and core exercise apparatus 800 (referred to at times as "Centaur"). Note the user sits in one position for all exercises facing a video display screen 102.

Many elements of lower extremity and core exercise apparatus 800 are substantially similar to upper extremity exercise apparatus 100 with notable exceptions.

- Exercise of the legs vs. the arms
- Different supportive pads for the legs vs. arms
- Additional exercise of the hip (flex and extend, abduction and adduction)
- Weight selection with a handle rather than a pedal
- Weight assistance with a cross bar (that doubles as a flexion/extension exercise for the midsection) vs. a pedal FIG. 31A and FIG. 31B are perspective views of the proximal portion of the right sided lower extremity and core exercise apparatus 800 operated by the user. The apparatus contains four cable pull units 280, B1-4, previously described in FIG. 7. There is one less cable pull unit 280 distally, as compared to the Gunner unit, as only flexion/extension of the ankle are provided whereas an additional cable pull unit 280 was situated in Gunner for the wrist to include rotation and gripping. There are two additional proximal cable pull units 280 to allow for hip flexion/extension, B2, and hip abduction/adduction, B1. Units B3 and B4 and associated equipment for lower extremity and core exercise apparatus 800 are identical in construction and operation to the Gunner system with the exception they are larger to handle the heavier resistance load. The B1 and B2 units operate in the same fashion as the cable pull units 280 of the Gunner apparatus. The B1 unit operates differently than units B2-4 as detailed in FIG. 31*b*.

In FIG. 31*b*, flat cable 203 passes around pulley lower pulley 820, around upper pulley 826, and down to terminator 825. Terminator 525 connects flat cable 203 to round cable 824. Round cable 824 then passes around pulleys 822, 827, 828, and 829 and through beveled gear 833. Pulleys 822 and 827 are fixed by beam 823 and fixed to plate821. As the user abducts or adducts the thighs, axle 831 rotates with first beveled gear 832 on second beveled gear 533, rotating cable pull unit 280 about its axis shown by the arrow. This causes traction on flat cable 203 and subsequently round cable 524.

FIG. 32A-C are diagrams highlighting the support pad system of lower extremity and core exercise apparatus 800 Armatures are simplified for discussion purposes and only the right and center pads are shown for clarity. Top armature 835 extends from the user's hip to knee, middle armature 836 from knee to ankle, and lower armature 837 from ankle to foot. Support pads can be fixed providing stability of a joint while another joint is exercised or allow the user to push against the pad as the pad and armature move during the stroke of an exercise.

Lower pad 839 supports flexion/extension of the ankle. Lower side pad 840 keeps the user's foot from sliding off medially. Lower pad 839 attaches to lower rod 838 supported by lower curved support 880 allowing lower pad 839 to rotate freely. Lower curved support 880 attaches to lower armature 837 by a socket obscured in this view.

Middle pad 844 supports flexion/extension of the knee. Middle side pad 845 keeps the user's foot from sliding off medially. Middle pad 844 attaches to middle rod 843 supported by middle curved support 842 allowing middle pad 844 to rotate freely. Middle curved support 842 attaches to armature middle armature 836 by socket 841.

Upper pad 848 supports flexion/extension and abduction/adduction of the hip. Upper pad extensions 849 keep the user's knee from sliding off medially but also provides support for the abduction/adduction exercise. Upper pad 848 attaches to upper rod 847 supported by upper curved support 846 allowing the pad to rotate freely. Upper curved support 846 attaches to upper armature 834 by a socket obscured in this view.

The user's seat comprises three parts: a lower horizontal pad 850, a vertical pad 851, and shoulder supports 852. The angle of vertical pad 851 relative to lower horizontal pad 8500 is adjustable to be fixed at a particular angle or move with exercise with vertical pad 851 positioning ranging from parallel to lower horizontal pad 850 to an acute angle of approximately 30 degrees. Shoulder pads 852 support the body during exercises where the angle between vertical pad 851 and lower horizontal pad 850 are obtuse. FIG. 32*b* provides the same view as FIG. 32*a*, rotated 90 degrees.

In other embodiments, the user has both sides of the joint supported, so the user doesn't have to change limb position for an opposing exercise. This could be especially convenient if the user is immersed in an interactive video game requiring rapid change from, for example, a flexion to extension exercise. In this alternate embodiment, "double pads" may be employed on each side of the limb as shown in FIG. 32*c*, with double lower pads 882, double middle pads 84 and double upper pads 886. FIG. 32*d* provides the same view as FIG. 32*c*, rotated 90 degrees. FIGS. 33A and B are perspective views of the detail of the lower extremity and core exercise apparatus and its weight selection assembly and weight assist/midsection assembly. FIG. 33*a* shows the two elements with most of the rest of the apparatus removed. FIG. 33*b* shows the two elements with most of the rest of the apparatus removed from another angle and with the two elements in a partially exploded diagram.

Referring to FIG. 33*b*, weight selection assembly is described. Button and shaft selector 901 allow the user to unlock the selector, then angle the selector forward or backward to increase or decrease the weight, respectively by rotating ratchet 902. Rotating ratchet 902 pulls first cables 903 rotating first pulley 904, pulling second cables 905, rotating second pulley 906, rotating shaft 907, rotating first beveled gear 908, rotating second beveled gear 909, and finally rotating weight selector 910, the structure and function of which are provided in a co-pending U.S. patent application Ser. No. 17/825,991 filed May 26, 2022, naming the same inventor as the present application, which is incorporated herein by reference.

Again, referring to FIG. 33*b*, the weight assist/midsection assembly is described. This is a dual function apparatus for working out the midsection (abdominals and lower back) or push/pull on the bar 912 to give weight assistance to the lower body exercises. The user pushes/pulls on the pad 911 or bar 912 that connects to armature 914 rotating about axis 916. Bar 912 connects to armature 914 through a swivel joint and pin 913 allowing the bar to be repositioned out of the way 90 degrees. Selection pin 915 allows a varying total length of armature 614. As armature 914 rotates about axis 916, it rotates flat cable unit 280 causing traction on flat cable 917 that traverses pulley 918 to flat/round cable converter 919, continuing as round cable 920 around pulley 912, then ascends to the upper pulley providing weight assistance described in co-pending U.S. patent application Ser. No. 17/825,991 filed May 26, 2022, naming the same inventor as the present application, which is incorporated herein by reference.

FIGS. 34A, 34B, 35A, 35B, 36A, 36B, 37A and 37B are perspective views of various start and finish positions of the presently described lower extremity and core exercise apparatus. Note that for each of the "a" and "b" positions, either can be the start or finish of the exercise stroke exercising opposite muscle groups.

FIGS. 34A and B show exercise of the abdominal and iliopsoas muscles with "a" as the start and "b" as the finish. Reversing the start and finish positions exercises the lower back and gluteus muscles.

FIGS. 35A and B show exercise of the anterior thigh muscles with "a" as the start and "b" as the finish. Reversing the start and finish positions exercises the posterior thigh muscles.

FIGS. 36A and B show exercise of the posterior calf muscles with "a" as the start and "b" as the finish. Reversing the start and finish positions exercises the anterior calf muscles.

FIGS. 37A and B show exercise of the lateral hip and thigh muscles with "a" as the start and "b" as the finish. Reversing the start and finish positions exercises the medial hip and thigh muscles.

FIG. 38 is a diagram of weight stack 740 in position. A plurality of individual weight plates is shown transparently for illustrative purposes.

FIG. 39 is a diagram isolating the major components of the weight stack 740. Plate stack 740*a* comprises a stack of a plurality of individual weight plates. While conventional weight stacks increase at similar intervals, e.g. 10 lbs, plate stack 740*a* in one embodiment includes lighter weights at the top of plate stack 740*a* weighing less than 10 lbs. and increasing as plate stack 740*a* progresses toward the bottom of plate stack at intervals greater than 10 lbs. For example, the weight of each plate (in lbs for an 18 plate weight stack) could be 5 lbs×5, 10 lbs×5, 20 lbs×5, 40 lbs×3 for a total weight stack of 295 lbs.

Concentrically positioned and imbedded in plate stack 740*a* within weight stack 740 are C-shaped rods 742. C-shaped rods 742 allow selection of one or more of the eighteen individual plates that comprise plate stack 740*a* Each rod 742 comprises a short, horizontal, upper rod 743, a variable length, vertical rod 747, and lower horizontal rod 748, identical in length to upper rod 743. Depending on the rotation position of selection carriage 910, lower horizontal rod 748 a given C shaped rod 742 is selected. C-shaped rods 742 traverse the peripheral holes 741 in plate stack 740*a*.

Selection carriage 910 traverses through weight selection rod 730 that slides in and out of the center hole 745 in plate stack 740*a* holding and guiding the plates.

FIG. 40 is carriage assembly of weight stack 740 according to an embodiment. Selection carriage 910 in one embodiment is a half cylinder meant to lift C shaped rods 742 that hold the plates within plate stack 740*a*. As rod 730 (shown in FIG. 21) is rotated by the ratchet system described in FIG. 19, selection carriage 910 rotates with it. The user can also manually rotate the carriage to any selection rod by twisting rotatable connector 616. When the plates are at rest, selection carriage 940 lies slightly below the level of top aspect of C-shaped rods 743 (see FIG. 23). Selection carriage 910 lifts the given C-shaped rod 742 through contact with 743 and all the weight plates above the corresponding 748 pin of 742. Fixed position cylindrical sleeve 752, displays "lbs." and "kgs" (751). As selection carriage 910 rotates to a new position, "lbs.: and "kgs." are displayed in the window 750 of 752.

Figure 41B:
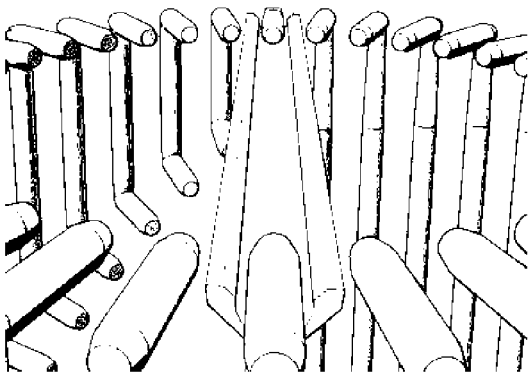
Figure 41C:
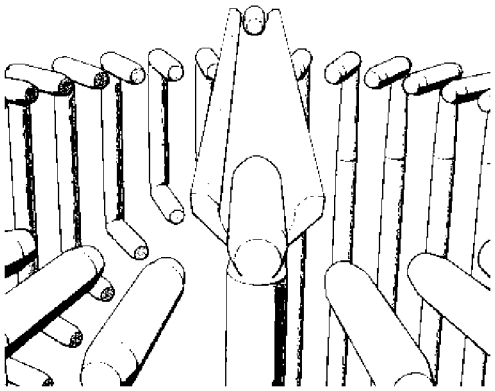

FIGS. 41A-C depict selection carriage 940 at various positions. FIG. 29*a* shows the weights at rest with selection carriage 940 lying below the plane of the upper portion of the selected C-shaped rod 742*a*. This allows the selection carriage to rotate to the other C-shaped rods. FIG. 29*b* shows the selection carriage first touching the selected C-shaped rods to lift them at 743. FIG. 29*c* shows the selection carriage having lifted the selected C-shaped rods a small distance. Note the selection carriage also lifts the C-shaped rods from opposite side for stability.

I claim:

1. A mechanical exercise apparatus configured for isolated and compound exercises of an upper extremity, comprising:

at least three interacting cable pull units accommodating a multiplicity of exercise positions of a first armature during exercise;

a plurality of pulley assemblies, each pulley assembly of the plurality of pulley assemblies respectively associated with an interacting cable pull unit of the at least three interacting cable pull units, each pulley assembly comprising three sets of dual pulleys double pulleys;

a wrist exercise handle configured for flexion, extension, lateral excursion or medial excursion of the wrist, internal rotation or external rotation of the wrist, and gripping exercise, wherein the wrist exercise handle is associated with one of the at least three interacting cable pull units;

a cable converter for converting a flat cable to a round cross-section cable and taking up cable slack to accommodate for various physical sizes of users; and a pedal weight selector attached to a rotatable selection rod disposed on a weight stack for selection of a desired weight level, wherein each of the plurality of pulley assemblies is adjustable to select a cable tension and a rotation angle starting position of the first armature in relation to a second armature during exercise.

2. The mechanical exercise apparatus of claim 1, further comprising a video display disposed on a frame assembly.

3. The mechanical exercise apparatus of claim 2, wherein the video display displays information comprising television programs, movies, streaming entertainment, exercise dynamics training programs, interactive games, and team competitions.

4. The mechanical exercise apparatus of claim 1, further comprising a coaxial sleeve disposed on the wrist exercise handle comprising a selector pin allowing engagement or disengagement of the wrist exercise handle.

5. The mechanical exercise apparatus of claim 1, wherein the wrist exercise handle comprises a first grip handle and a second grip handle.

* * * * *